US011988070B2

(12) United States Patent
Leiper et al.

(10) Patent No.: US 11,988,070 B2
(45) **Date of Patent: *May 21, 2024**

(54) DRILL STRING MOUNTABLE WELLBORE CLEANUP APPARATUS AND METHOD

(71) Applicant: Odfjell Well Services Norway AS, Tananger (NO)

(72) Inventors: Simon Leiper, Dubai (AE); Kevin Robertson, Insch Aberdeensir (GB)

(73) Assignee: Odfjell Well Services Norway AS, Tananger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 18/155,339

(22) Filed: Jan. 17, 2023

(65) Prior Publication Data

US 2023/0250709 A1 Aug. 10, 2023

Related U.S. Application Data

(63) Continuation of application No. 17/215,834, filed on Mar. 29, 2021, now Pat. No. 11,560,773, which is a continuation of application No. 16/846,500, filed on Apr. 13, 2020, now Pat. No. 10,961,822, which is a continuation of application No. 16/259,617, filed on (Continued)

(51) Int. Cl.

| | |
|---|---|
| ***E21B 17/00*** | (2006.01) |
| ***E21B 17/04*** | (2006.01) |
| ***E21B 17/10*** | (2006.01) |
| ***E21B 19/16*** | (2006.01) |
| ***E21B 37/00*** | (2006.01) |
| ***E21B 37/02*** | (2006.01) |

(52) U.S. Cl.

CPC ..... *E21B 37/02* (2013.01); *E21B 17/006* (2013.01); *E21B 17/04* (2013.01); *E21B 17/1078* (2013.01); *E21B 19/16* (2013.01); *E21B 37/00* (2013.01)

(58) Field of Classification Search

CPC ..... E21B 37/02; E21B 37/00; E21B 17/1078

See application file for complete search history.

(56) References Cited

U.S. PATENT DOCUMENTS 2,973,996 A * 3/1961 Self ..... E21B 17/1078 175/323

4,384,626 A * 5/1983 Derouin ..... E21B 17/1078 175/57

(Continued)

FOREIGN PATENT DOCUMENTS

WO WO-9316833 A1 * 9/1993 ..... B23D 79/023

*Primary Examiner* — Daniel P Stephenson

(74) *Attorney, Agent, or Firm* — Roy Kiesel Ford Doody & North, APLC; Brett A. North

(57) ABSTRACT

A drill pipe mountable wellbore cleaning tool apparatus that enables attachment to a drill pipe joint having first and second connector end portions and a cylindrically shaped portion in between the connector end portions The apparatus includes a support sleeve that is mounted to the drill pipe joint in between the connector end portions. Centralizers are attached to the opposing ends of the support sleeve, with each centralizer overlapping a portion of the support sleeve. At least one locking clamp is attached to the cylindrical portion next to a said centralizer. The locking clamp prevents the support sleeve from moving longitudinally along the drill pipe joint.

20 Claims, 24 Drawing Sheets

Related U.S. Application Data

Jan. 28, 2019, now Pat. No. 10,619,454, which is a continuation of application No. 15/888,287, filed on Feb. 5, 2018, now Pat. No. 10,190,393, which is a continuation of application No. 15/390,881, filed on Dec. 27, 2016, now Pat. No. 9,885,227, which is a continuation of application No. 14/829,136, filed on Aug. 18, 2015, now Pat. No. 9,528,325, which is a continuation of application No. 13/710,644, filed on Dec. 11, 2012, now Pat. No. 9,109,417.

(60) Provisional application No. 61/665,110, filed on Jun. 27, 2012.

(56) References Cited

U.S. PATENT DOCUMENTS 6,227,291 B1 * 5/2001 Carmichael ..... E21B 37/02 166/173
6,227,297 B1 * 5/2001 Milam ..... B08B 9/023 166/173
9,109,417 B2 * 8/2015 Leiper ..... E21B 37/00
9,528,325 B2 * 12/2016 Leiper ..... E21B 37/02
9,885,227 B2 * 2/2018 Leiper ..... E21B 37/00
10,190,393 B2 * 1/2019 Leiper ..... E21B 37/00
10,619,454 B2 * 4/2020 Leiper ..... E21B 17/006
10,961,822 B2 * 3/2021 Leiper ..... E21B 17/04
11,560,773 B2 * 1/2023 Leiper ..... E21B 37/00
2004/0177967 A1 * 9/2004 Hirth ..... E21B 33/12 166/173
2010/0096122 A1 * 4/2010 Posevina ..... E21B 37/02 166/173
2011/0168383 A1 * 7/2011 Davis ..... E21B 37/02 166/173
2011/0265988 A1 * 11/2011 Hern ..... E21B 37/02 166/173
2011/0284203 A1 * 11/2011 Hern ..... E21B 37/00 166/66.5
2013/0153245 A1 * 6/2013 Knobloch ..... E21B 31/08 166/99
2014/0000900 A1 * 1/2014 Leiper ..... E21B 17/006 166/173
2021/0317725 A1 * 10/2021 Leiper ..... E21B 19/16

* cited by examiner

G-G

F-F

E-E

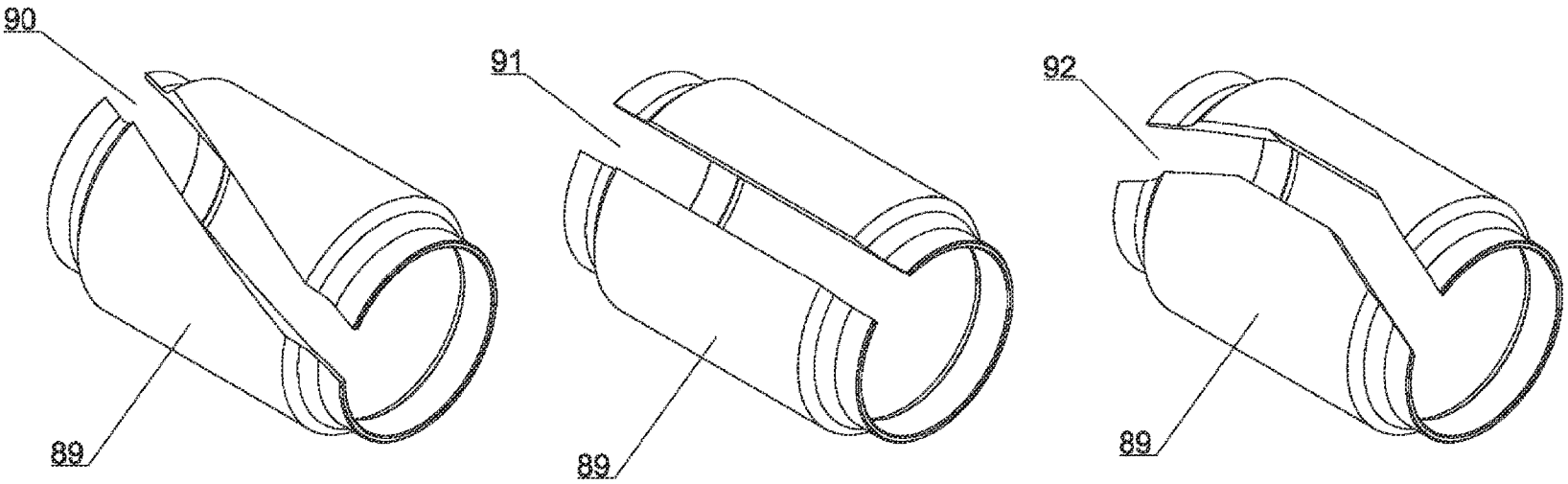
FIG. 23
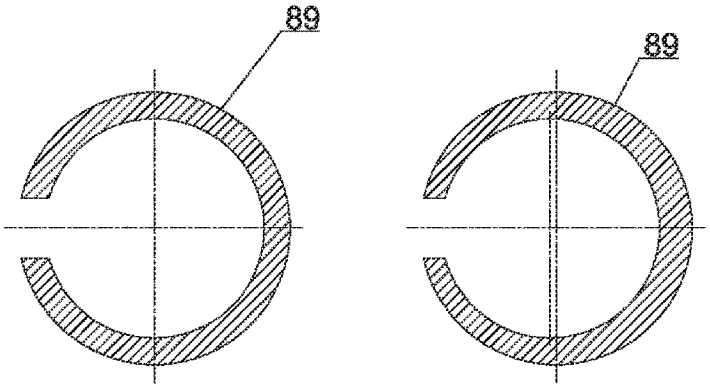
FIG. 25
FIG. 26
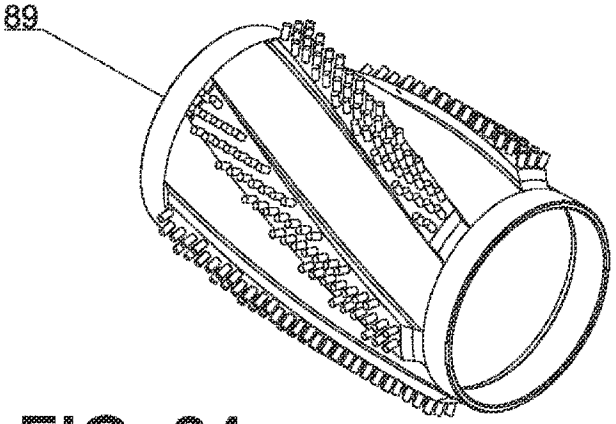
FIG. 24

DRILL STRING MOUNTABLE WELLBORE CLEANUP APPARATUS AND METHOD

CROSS-REFERENCE TO RELATED APPLICATIONS

This is a continuation of U.S. patent application Ser. No. 17/215,834 (issuing as U.S. Pat. No. 11,560,773 on Jan. 24, 2023), which is a continuation of U.S. patent application Ser. No. 16/846,500 (now U.S. Pat. No. 10,961,822), which is a continuation of U.S. patent application Ser. No. 16/259,617, (now U.S. Pat. No. 10,619,454), which is a continuation of U.S. patent application Ser. No. 15/888,287, (now U.S. Pat. No. 10,190,393), which is a continuation of U.S. patent application Ser. No. 15/390,881, filed on Dec. 27, 2016, (now U.S. Pat. No. 9,885,227), which is a continuation of U.S. patent application Ser. No. 14/829,136, filed on Aug. 18, 2015, (now U.S. Pat. No. 9,528,325), which is a continuation of U.S. patent application Ser. No. 13/710,644, filed on Dec. 11, 2012 (now U.S. Pat. No. 9,109,417), which claims benefit of U.S. Provisional Patent Application Ser. No. 61/665,110, filed Jun. 27, 2012, each of which applications/patents are incorporated herein by reference and to/of each of which priority is hereby claimed.

BACKGROUND OF THE INVENTION

1. Field of the Invention

The present invention relates to a method and apparatus for cleaning a wellbore with specially configured drill string mounted tools. More particularly, the present invention relates to a tool apparatus that enables debris removal tools (e.g., scraper blades, brushes or magnetic members/magnets) to be mounted to the outer cylindrically shaped surface of a section or joint of a drill string/drill pipe with a specially configured locking clamp or clamps.

2. General Background of the Invention

The Drilling of an oil well typically requires the installation into the wellbore of steel walled casing. This casing is cemented into place to provide a gas tight seal between the overlapping casing strings and also between the casing and the formation or rock through which the well is drilled. Typical cementing practice requires the cement to be pumped from the surface area or wellhead down a string of internal tubing or down the inner most casing string and displaced through the bottom of the casing string into the casing annulus. This procedure may contaminate the inside of the casing wall or wellbore with the cement. After cementation is completed, it is often required to drill out cement and the associated cementation equipment (commonly referred to as shoe track, floats shoe, landing collar, and darts).

Chemicals, solids, greases and other fluids used in the drilling process can and do adhere to the casing wall. These chemicals often mix to become a sticky and viscous substance which is largely resilient to chemical treatments and difficult to remove. As the wellbore casing is steel walled, it can and is prone to rusting and scaling.

During the drilling and other downhole activities, pieces of the drilling or wellbore equipment may need to be milled. Through various other processes (purposeful or accidental), pieces or parts can be left inside the wellbore. The aforementioned situations result in contaminants being left in the wellbore, which will for the purposes of this document be referred to as debris.

During the completion phase in a well lifecycle, several pieces of hardware are semi-permanently installed into the wellbore. These vary greatly in complexity and cost. Their primary function is the transportation of produced hydrocarbons (or injection from surface of other fluids) between the reservoir and the Christmas tree/wellhead (or vice versa) as well as maintaining hydrostatic control of the wellbore at all times. Completions typically include steel tubular piping to transport the fluids, at least one hydrostatic sealing device (packer) and one safety valve. More complex completions may include gauges to measure pressure and temperature at multiple points in the wellbore. Other items may include chokes, screens, valves and pumps. Advancements in downhole electronics make the placement of measuring and controlling equipment more accessible and more commonplace.

Typically these components are sensitive to debris. It has been well documented that debris is a leading root cause of failure during completion operations. In response, a niche industry has developed since the late 1990s, which is focused on the removal of debris and the cleaning of the wellbore. This niche of the oil industry is known as wellbore cleanup. The wellbore cleanup operations will typically take place between the drilling and completion of the well.

Generally speaking, the practice of wellbore cleanup is not new. Examples of prior art go back many years when basic embodiments of wellbore cleanup tools were developed, including scrapers, brushes, magnets, junk catchers and variations thereof. These were basic tools designed to fit a basic need, examples of which are still in use today.

As advancements in drilling and completion technologies were made (particularly starting in the 1990's with the inclusion of downhole electronics, sand control, intelligent completions and extended reach drilling) improvements to the design and functionality of wellbore cleanup tools were marketed, and the practice of improving the cleanliness of oil wells prior to installation of the completion components became almost standard practice. During the wellbore cleanup operations, an assembly of tools (referred to as a bottom hole assembly or BHA) will be run into the wellbore to clean each casing section. These tools are fastened together using threaded connections located at either end of the tool. The tools or BHA are then fastened together with the drill string or work string consisting of multiple lengths of drill pipe, collars, heavy weight drill pipe, wash pipe or tubing also featuring threaded connections. These threaded connections are typically industry standard connections as defined in ANSI/API Specification 7-2 (for example 4½" IF/NC50 or 3½" IF/NC38) and commonly referred to as API connections. Also available are proprietary connections which are licensed from manufacturers of high strength drill pipe. Popular proprietary connections are supplied by NOV—Grant Prideco (eXtreme Torque, HI Torque, Turbo Torque), Hydrill (Wedge Thread) and others. The proprietary connections are often referred to as premium drill pipe connections and are typically used when higher mechanical strengths are required (e.g., torque, tensile strength, fatigue resistance, etc.) or when larger diameter drill pipe is preferred relating to the improvement of drilling hydraulics. For example, it is common now to use 5⅞" OD drill pipe inside 9⅝" casing to improve hydraulics whereas in the past it would have been more common to use 5" drill pipe).

The table below shows some examples of drill pipe and connection combinations used for a typical casing size;

however, due to the many manufacturers and standards available, there may be thousands of combinations.

Note: The Drill Pipe OD refers to the Pipe Body OD and not the maximum external of the component. The Tool Joints are always of larger diameter. Also the Casing Size is defined by the Nominal OD and the linear weight per foot. API 5-CT allows for a tolerance in the diameter and ovality. Therefore the Casing ID may vary significantly.

this, it is often practice to supply pup joints which are typically ten feet (10') or less in length and have a profiled external diameter which matches the drill pipe and which fits into the drilling elevators and drill pipe slips to facilitate the installation and removal of the drill string into/from the wellbore in a timely fashion. There also exists pup-overs which are a combination of pup joint and crossover and which combines the functionality of both.

| Casing Size | | Typical Nominal Casing | | |
|---|---|---|---|---|
| OD | ID | Drill Pipe Connections | Drill Pipe OD | Drill PipeTool Joint OD |
| 9.625" | 8.374"-8.921" | API NC50 (4½" IF) | 5.0" | 6.375"-6.750" |
| 9.625" | 8.374"-8.921" | TT/HT/XT50 | 5.0" | 6.375"-6.750" |
| 9.625" | 8.374"-8.921" | TT/HT/XT55 | 5.5" | 7.0"-7.375" |
| 9.625" | 8.374"-8.921" | TT/HT/XT57 | 5.875" | 7.0"-7.375" |
| 9.625" | 8.374"-8.921" | WT50 | 5.0" | 6.5/8"-7.0" |
| 9.625" | 8.374"-8.921" | WT54 | 5.5" | 7" |
| 9.625" | 8.374"-8.921" | WT56 | 5.875" | 7"-7¼" |

Wellbore cleanup tools come in a variety of types and brand names. However, they can be categorized generally as one of the following: a scraper, brush, magnet, junk basket, debris filter, circulation sub, drift or a combination of two or more of these. These tools shall typically consist of a tool body onto which the various components can be attached. The tool body may consist of one or more pieces, but shall in all cases include threaded drill pipe connections, either API or Premium type. The tool body is typically an integral drill string component when made up into the drill string and shall bear all the tensile, torque, fatigue and pressure loading of the drill string. The tool body is typically made of steel and customized to allow attachment of the various components in order for it to function in the manner described.

Due to the many variations of drill pipe connections, the variety of casing sizes, and the many types of wellbore cleanup tools required, it would be commercially impractical for a company providing wellbore cleanup tools to stock every combination required from every customer. Therefore the practice of designing wellbore cleanup tools to cover a range of casing sizes as well as a variety of functions has become common practice, whereby the tool body can be used with interchangeable external components to cover both the size range and in some cases also to alter the function of the tool (for example from a scraper to a brush). This allows standardization of the tool body, however as the drill pipe connections are hard cut onto the tool body, a degree of standardization of the tool body connections are required. Typically this is the API drill pipe connection common to that casing size (NC50 for 9⅝" casing or NC38 for 7" casing). In some cases the wellbore cleanup tool manufacturer may supply the tools with premium drill pipe connections, however for commercial reasons this is usually limited to specific projects or markets where the use of the corresponding drill pipe justifies this.

It is common for suppliers of wellbore cleanup tools to supply either individual tools or assemblies of tools where the individual tools have a type of drill pipe connection which is not the same as that used in the drill string. In this case it is common for the tools to be supplied with crossovers. Crossovers are typically short "subs" (joints of tubing) with differing connections at each end. For example, a XT-57 box thread can be at the top with an API NC50 pin at the bottom. This allows components of the drill string with non-interchangeable threaded end connections to be made up together into a singular integral drill string. Further to Wellbore cleanup tools and drill string often have mismatching threaded connections, and the wellbore cleanup tools are usually rated to lower strengths. The lower strength of the cleanup tools in effect reduces the overall strength of the drill string, which is typically rated by the strength of its weakest link. This has become an acceptable practice provided the drilling parameters do not exceed the limitations of the weakest point. The situation can arise during the cleanup operations that high torque can be observed during rotation of the drill string which results in rotation of the string being suspended. Drill string rotation is a key function of wellbore cleanup in the removal of debris from the wellbore, the lack of which significantly impacts the efficiency and effectiveness of the wellbore cleanup.

The requirement to include crossovers and pup joint into the drill string increases the number of threaded connections into the drill string which in turn increases the time and cost to deploy the drill string, increases the inspection costs and increases the likelihood of failure. The inventory of crossovers and pup joints needs to be managed, which includes storage, handling, inspections and maintenance. Due to the many types of drill pipe connections and the varying sizes, and the need to maintain sufficient inventory for multiple overlapping operations, the stocking and management of these inventories is a cost prohibitive endeavor.

SUMMARY OF THE INVENTION

The apparatus of the present invention solves the problems confronted in the art in a simple and straightforward manner.

The present invention provides an improved wellbore cleaning method and apparatus whereby wellbore cleanup tools perform the functions of a scraper, brush, magnet and wellbore filter. The tool apparatus of the present invention provides external mounting to the drill pipe cylindrical portion in between the pipe "pin" and "box" end portions and securely attached by a special method and configuration which prevents the tools from being accidentally removed during the wellbore cleanup operations.

Drill pipe joints provide a solid tubular body with uniform diameter and external 'tool joints' (i.e., pin and box) of larger diameter which contain the threaded connections. Since the tools are mounted externally to the drill pipe, there are no tool bodies as such, and therefore there is no reduction in the drill string strength through the introduction of a tool body, crossover, pup joint, and drill pipe connection. This arrangement eliminates the need to maintain an inventory of crossovers or to have stock of tool bodies with multiple threaded connections.

The wellbore cleanup tools of the present invention are designed with the principal that if one component were to fail, it would not result in the equipment coming loose from the drill pipe and being left in the wellbore.

In one embodiment the tool internal components are split longitudinally and bolted together about the drill pipe. Robust external rings of single piece construction and with robust internal threads are mated to the split internal components. This external ring covers the aforementioned bolts to prevent them from loosening. The external ring is prevented from loosening by two methods. First, the thread is orientated in such a way that rotating the drill pipe in the conventional manner (clockwise) will tighten the thread due to the friction of the tool against the casing. Secondly grub screws are backed out into internal pockets and secured with springs which prevent any movement of the external ring once secured. This arrangement works positively with the resultant centrifugal forces imparted during rotation of the string.

The tool designs of the present invention are modular and can be deployed individually or in any combination as required by a user or customer. The tools are mounted to the drill pipe body only radially and are free to rotate or move longitudinally along the pipe. They could not move past a tool joint (pin or box end) due to the larger external diameter. There can also be included in the present invention a locking device which consists of a set of toothed dogs, external threaded rings, and an internal split type clamp. When fully made up, the teeth grip the drill pipe, preventing any longitudinal movement. The purpose of this arrangement is to allow mounting of the locking device at any location on the drill pipe. This location may be above or below the mountable wellbore cleanup tools and be designed to limit the longitudinal movement of these tools which the drill string is being moved in the wellbore.

Prior art wellbore cleanup tools typically include drill pipe connections at either end, and have particular components allowing the tools to perform their designed actions, such as a scraper, brush, magnets, junk sub, debris filter or a combination thereof. In the prior art, it is common practice to deploy several such tools screwed together end on end, and it is also common to include crossovers, due to frequent incompatibility between the wellbore cleanup tool connections and the drill pipe connections. To reduce handling time on the rig floor while picking up and laying down such equipment, the installation of pup joints and/or handling pups is also common practice.

The main disadvantages to the above prior art systems are as follows:

Drill String Integrity—a drill string can be analogized as being similar to a chain, being only as strong as its weakest link:

Introducing connections which are not the same as the drill string compromises the mechanical integrity of that string. Most wellbore cleanup tools are designed with API connections, which are typically of lower mechanical strength than premium drill pipe connections. As such, introducing the required crossovers to the string reduces the overall strength of the string.

Many such tools include internal connections, which introduces another element of risk to overall drill string integrity. These internal connections are typically non-standard (do not conform to API).

Drill pipe connections are typically made from a high strength steel, typically of higher strength than the wellbore cleanup tools.

An important factor in prevention of fatigue failures of the drill string are bending strength ratios of the string and the connections. Adding additional wellbore cleanup tools as integral components may result in sub-optimal bending strength ratios at critical connections reducing the overall drill string integrity.

Rig Time—the daily operational costs of running a rig are one of the most significant cost impacts in drilling operations. Saving rig time reduces the overall cost of drilling a well, and those involved in this business know the importance the drilling operators place on time management.

Drilling rigs are designed generally to run drill pipe in an efficient manner. There are many examples of prior art where technology has been adapted or improved to reduce the time to handle the drill pipe on the drilling rig, including automated systems for handling the pipe, and for making and breaking connections.

Drilling rigs are generally not well adapted to running individual tools, whether they be wellbore cleanup tools or other types, as they are of non-standard lengths and shapes. With the assistance of pulleys, cranes and winches, these are manhandled onto the rig floor and made up either individually or in short pre-made sub-assemblies. This is generally a time-consuming practice and there is also an impact on the safety of the individuals running the equipment as they are exposed to manual handling of heavy equipment, pressure, dropped objects and other hazards typical of a rig floor.

Prior art methods of installation of prior art wellbore cleanup tools typically involve the following steps:

1. Placement or 'layout' of the required tools onto the 'catwalk' (temporary storage place for drill pipe and equipment being run into or pulled out of the wellbore) using slings, cranes, and/or forklifts. Risks include exposure to dropped objects and accidental crushing from working in proximity to heavy moving equipment.

2. Installation of lifting subs or handling pups to the individual tools and/or making the tools into small sub-assemblies to reduce handling time of the rig. Risks include manual handling of heavy equipment with injuries to fingers and toes.

3. Lifting the sub-assemblies and/or tools to the rig floor using the crane, tugger lines (winches) and/or forklifts. Risks include exposure to dropped objects.

4. In the case that the tools are already made into a completed assembly with pup joints that are of the correct type, it may be possible to install the pup joint directly into the drill pipe elevators and by use of the crane/tugger lines and other devices lift the entire assembly and make it up into the drill string.

5. More commonly the tools and sub-assemblies will be picked up individually. Typically one or more joints of drill pipe (or drill collars) will be suspended in the elevators with the lower pin connection around shoulder height on the rig floor. Alternatively a 'lifting sub' may be suspended in the elevators which has an external upset and a pin connection facing down typically compatible with the tools which shall be suspended from it.

6. Depending on the design of the BHA and drill string, there may be either drill pipe, or drill collars suspended from the rotary table by slips. The use of either type requires specialized 'slips' and possibly the installation of a 'dog collar' (a safety device designed to catch the string should the drill collar slips fail). There may be no lower string, in which case a bit or mill will be installed at the end of the wellbore cleanup BHA.

7. The sub-assemblies or tools are picked up one at a time using winches and the connections made up manually to the drill string. This is a time consuming process which involves the manual use of chain/strap wenches, pipe wenches, drill collar slips, dog collars and hammers. Each connection is also 'torqued' using either the semi-manual pipe tongs or using an automated unit such as a 'mechanical rough neck' before being lowered into the wellbore.

8. This process presents a risk to personnel as it involves multiple persons working with heavy equipment in close proximity. Drill pipe tongs and associated equipment are notorious for causing injuries to fingers while being used or causing crushing injuries when being handled or swinging free.

9. A further risk is accidental dropping of the string during make-up. Most tools typically come with 'slick' tool joints (no external upset) and are often shorter than ideal to allow safe installation of the drill collar type slips and the necessary dog collar. Drill collar slips rely on friction to suspend the drill string and are typically less reliable than drill pipe slips which suspend the string from an upset. If the drill collar were to fail and the dog collar not to hold, then the string would be dropped and free-fall into the wellbore resulting in a costly retrieval (fishing) operation.

Drilling operations are often conducted in remote locations, whether on land, or at sea. Often drilling may take place in countries with limited operational support bases, requiring equipment to be transported to and from the rig over vast distances requiring the use of air, land and sea transportation. Compounding this issue, downhole oilfield equipment tends to be elongated and heavy, requiring specialized baskets to deliver the equipment to the rig site as well as special boats with large deck space. These baskets can be as long as 40 ft. Furthermore, transportation of equipment by air is expensive due to length and weight of equipment and there is typically a premium to be paid to transport such equipment. Offshore drilling rigs have limited deck space to store equipment and minimizing the use of deck space is important to efficient operations. Servicing of the equipment at a logistics base is a labor intense process and requires specialized equipment, trained operators as well as access to third party inspectors.

The application of the invention in the method outlined in the following steps mitigates, eliminates or improves the problems listed above in the following manner.

1. Drill String Integrity—The wellbore cleanup tools as disclosed are externally mounted and secured to the drill pipe without the use of tool bodies. The drill string integrity remains intact as there are no inclusions of additional integral components and therefore no reduction in the integrity of the drill string.

2. Rig Time—The wellbore cleanup tools can be mounted to a single joint of drill pipe at the rig site. This action can be completed on the deck or catwalk away from the main area of operation. When required to be run in the hole, the single joint can be picked up to the rig floor either using the rig's automated systems or in the same manner as running a single joint from the catwalk or mouse-hole which would be the same method used when picking up single joints of drill pipe. It would also be possible to rack the joint in the derrick as part of a stand of pipe in the same manner as the other drill pipe stands are racked.

3. Logistics—As the wellbore cleanup tools do not have tool bodies, and are not required to be made into sub-assemblies prior to shipping, it is possible to ship them in short containers, without the need for the elongated basket typically used to ship other types of tools. This reduces the burden on the deck space onboard the rigs, supply boats and trucks. Furthermore, it reduces the cost of air transportation as the shipping boxes are no longer required to be elongated.

4. Safety—The use of this technology eliminates the need to perform single or sub-assembly pickups on the rig floor, which reduces exposure to common hazards of working on a rig floor such as finger injuries and crushing injuries while using the manual and semi-automated tools and equipment.

The following method describes the general application of one embodiment of attaching a mountable wellbore cleanup tool of the present invention to a joint of drill pipe on a rig location.

1. Begin with a single joint or section of drill pipe which is identical to the joints of drill pipe that comprise the drill string which is to be deployed in the wellbore.

2. Attach a support sleeve, which consists of two or more mated and largely identical pieces split longitudinally, about the drill pipe. These pieces when mated shall make a complete concentric part. The support sleeve can have an internal diameter slightly larger than the external diameter of the drill pipe body to permit rotation of the support sleeve relative to the drill pipe. The internal diameter of the support sleeve can be less than the external diameter of the drill pipe tool joints, such that the support sleeve can be abutted against the tool joint to limit the longitudinal movement of the support sleeve relative to the drill pipe.

3. The pieces of the support sleeve are mated using bolts, pins, hinges, or similar screw type fasteners. Depending on the configuration of the tools, either scraper, brush or magnetic elements may be attached to the support sleeve.

4. Typically the fasteners which secure the support sleeve together may not be of sufficient strength alone to prevent accidental detachment of the support sleeve downhole with disastrous effect. It is therefore necessary to install a plurality of centralizer rings to the support sleeve, which are to be inserted (slide) over the ends of the drill pipe tool joints. These centralizer rings can be of singular piece construction for strength. The internal diameters of the centralizer rings can be slightly larger than the external diameter of the drill pipe tool joints. The centralizer rings can be threaded internally and mated to an external thread on the support sleeve. Alternatively they may be secured to the support sleeve using bolts, pins, or screws and a combination of these fasteners/methods. Once installed, the centralizer rings shall completely or partially cover the fasteners used to mate the support sleeve pieces (e.g. halves) to prevent them from accidentally being removed.

5. To prevent the support sleeve and the assembled components from traveling longitudinally relative to the drill pipe it is necessary to install a locking clamp assembly. Once installed, the support sleeve and assembled components shall abut against the locking clamp at one end and can abut against a drill pipe tool joint at the other, thus preventing any longitudinal movement relative to the drill pipe. Alternatively, two locking clamps can be used to secure the support sleeve and assembled components.

6. To install the locking clamp to the drill pipe, the split slip ring is installed about the drill pipe body. This consists of a plurality of near identical pieces which when mated together make a concentric component. The internal diameter of the split slip ring is slightly larger than the drill pipe body to allow it to be installed and moved into position. The split slip ring pieces are mated using bolts, pins, hinges or similar screw type fasteners.

7. A plurality of slip segments are installed into or adjacent to the split slip ring. The slip segments have an internal profile which matches the external diameter of the drill pipe body and includes a toothed or serrated surface which engages the drill pipe body and prevents longitudinal and rotational movement once sufficient collapsing force is applied. The external profile of the slip segments is conical such that when a mated external component applies a longitudinal force, this conical section converts this force into a collapsing force using the mechanical advantage of the conic shape.

8. A plurality of slip cone rings are installed over the slip segments with an internal conical mating profile to engage the slip segment.

9. To complete the installation of the locking clamp, a tensioner sleeve is slid over the drill pipe tool joints and engaged by a thread to the split slip ring. This can be of singular piece construction. As the tensioner sleeve thread is tightened, it drives the slip cone rings longitudinally which in turn engage the slip segments, which in turn engage the drill pipe body. The tensioner sleeve internal diameter is slightly larger than the drill pipe tool joints to allow installation from one end.

10. The drill pipe single joint complete with installed mountable wellbore cleanup tool can then be picked up to the rig floor by whatever methods are employed upon that particular rig. This may include laying the single joint on the catwalk, placing it in the mouse-hole, making it up to a stand, or racking it in the derrick.

11. After completion of the wellbore cleanup operations, the installation process is reversed. The components can be stored back in their box for later operations or returned to the supply base.

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein:

FIG. 23 shows various broach arrangements;

FIG. 24 is a perspective view showing a brush type broach;

FIG. 25 is a sectional view showing a broach concentric ID construction;

FIG. 26 is a sectional view showing a broach eccentric broach construction;

DETAILED DESCRIPTION OF THE INVENTION

Figure 1:
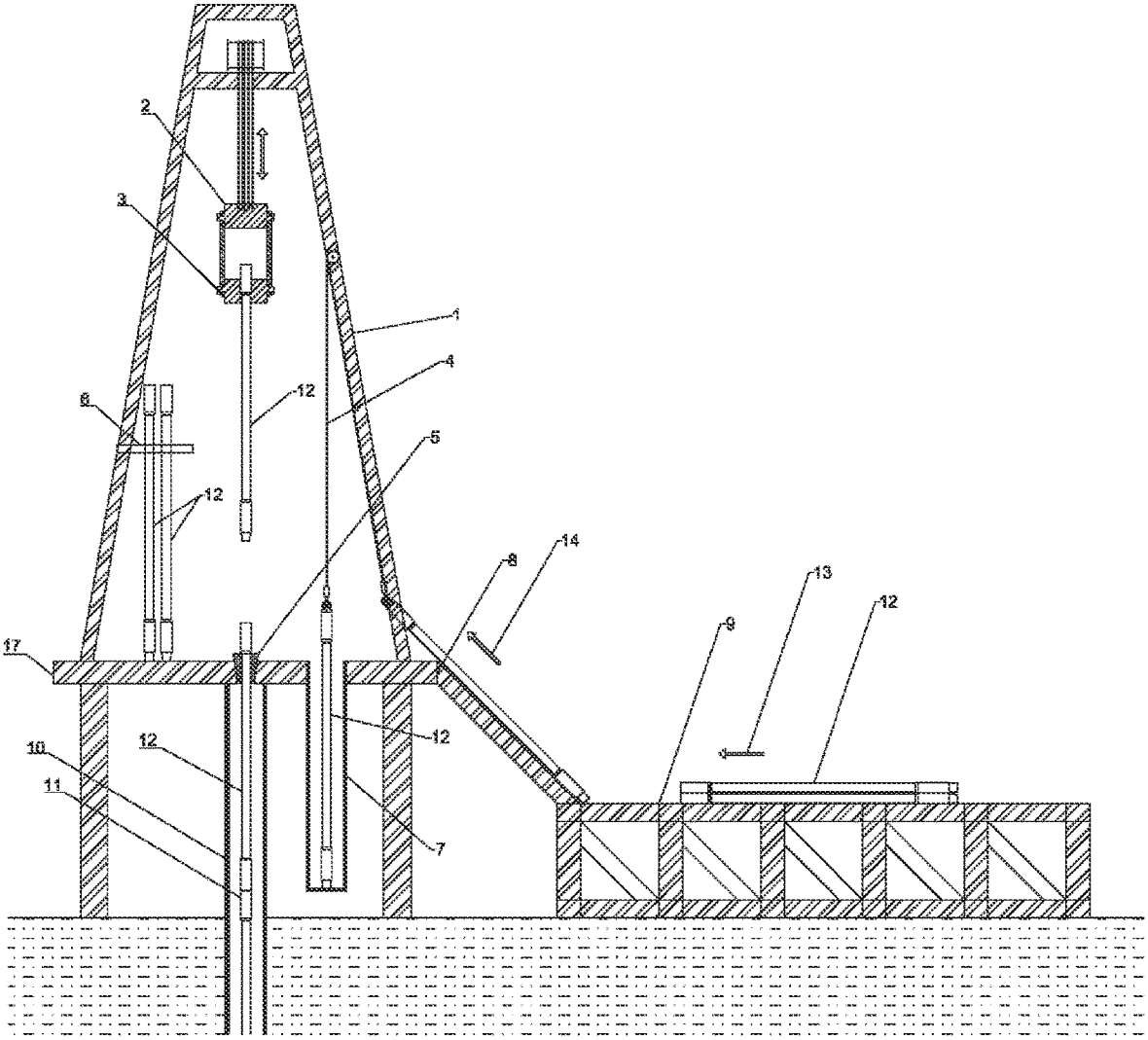
FIG. 1 is an elevation view of a normal drilling operation showing the handling of drill pipe.
Figure 2:
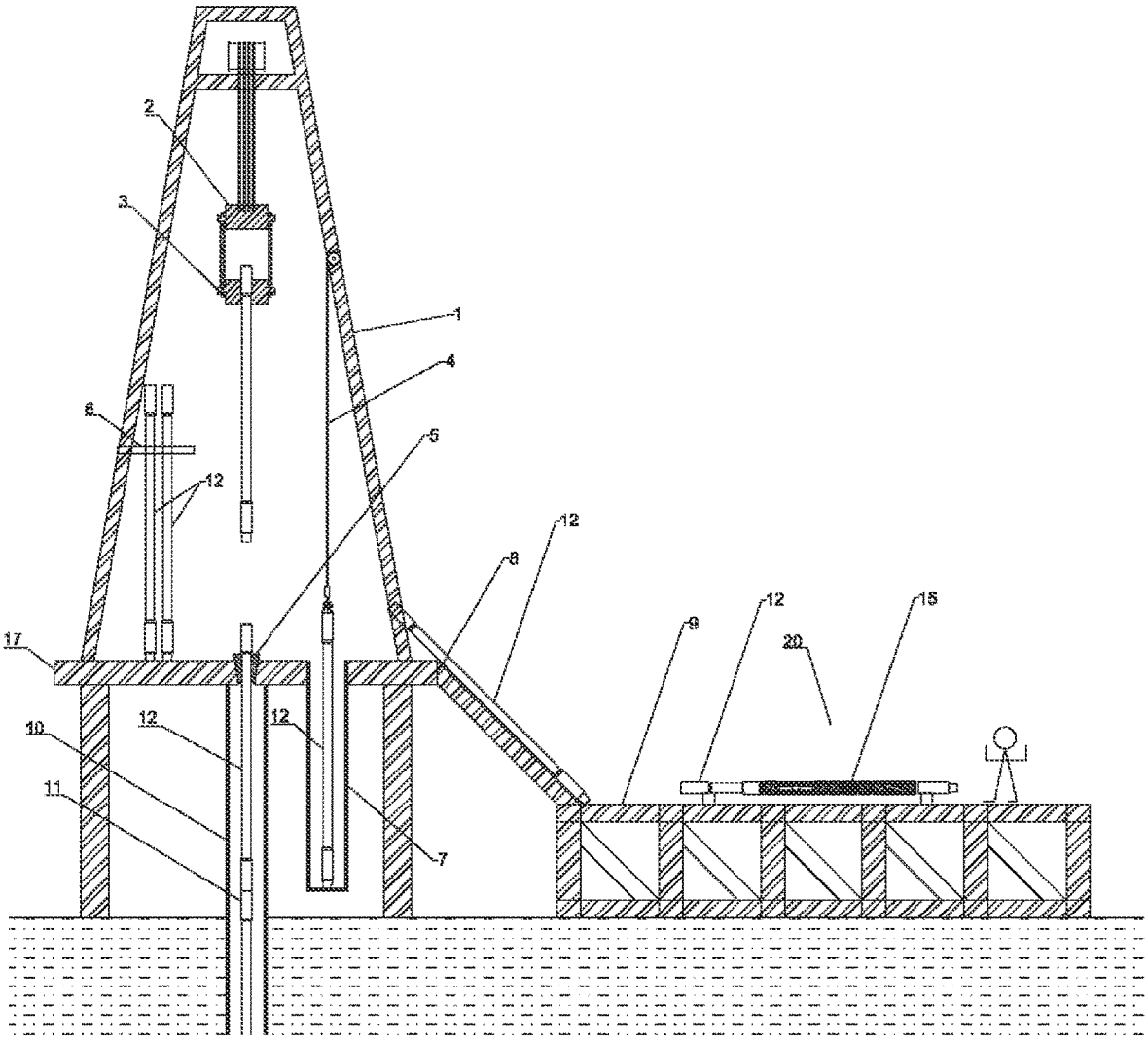
FIGS. 2-4 are elevation views illustrating the method of the present invention and showing the mountable wellbore cleanup tool apparatus of the present invention as part of drilling operations.
Figure 3:
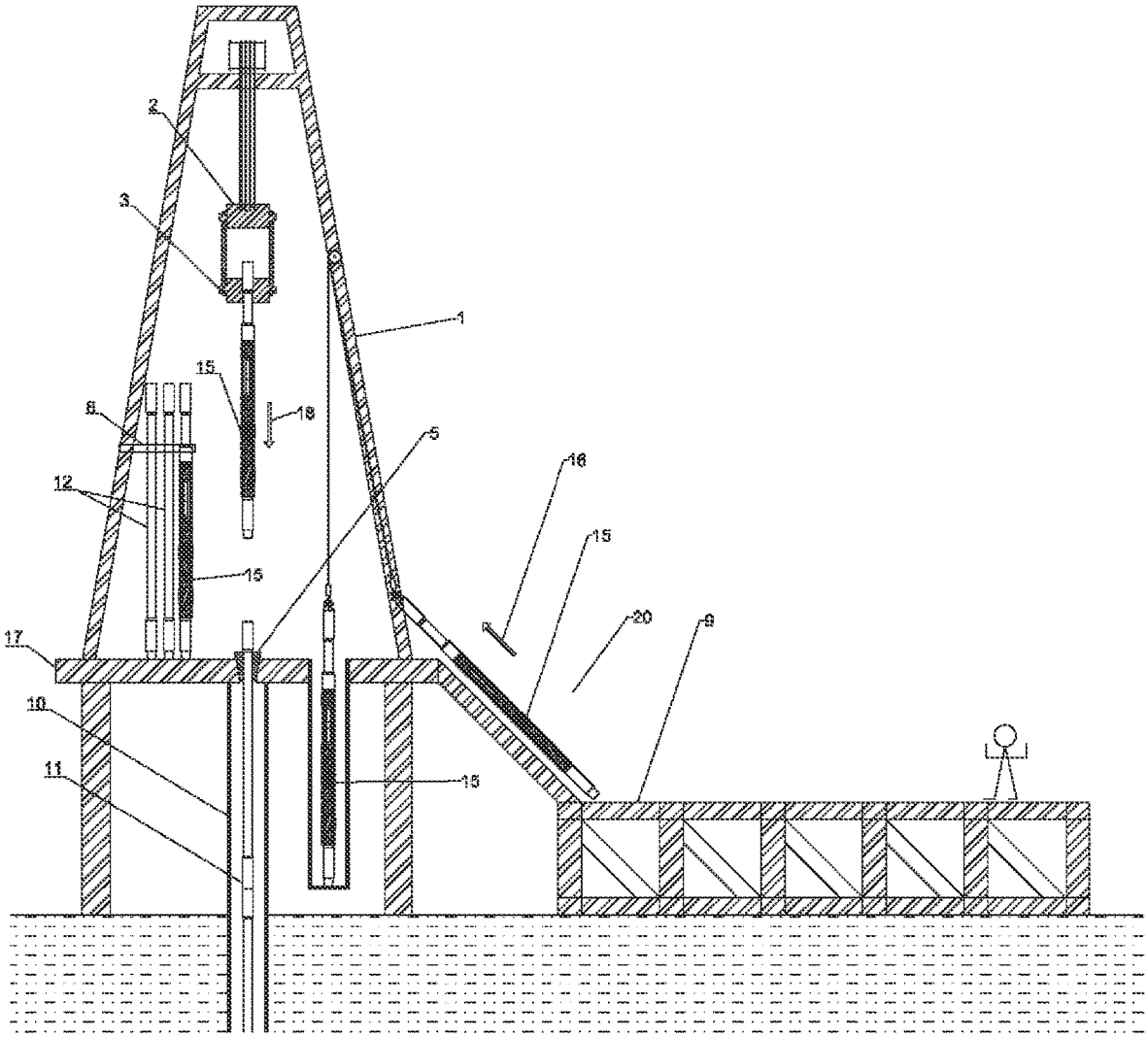
Figure 4:
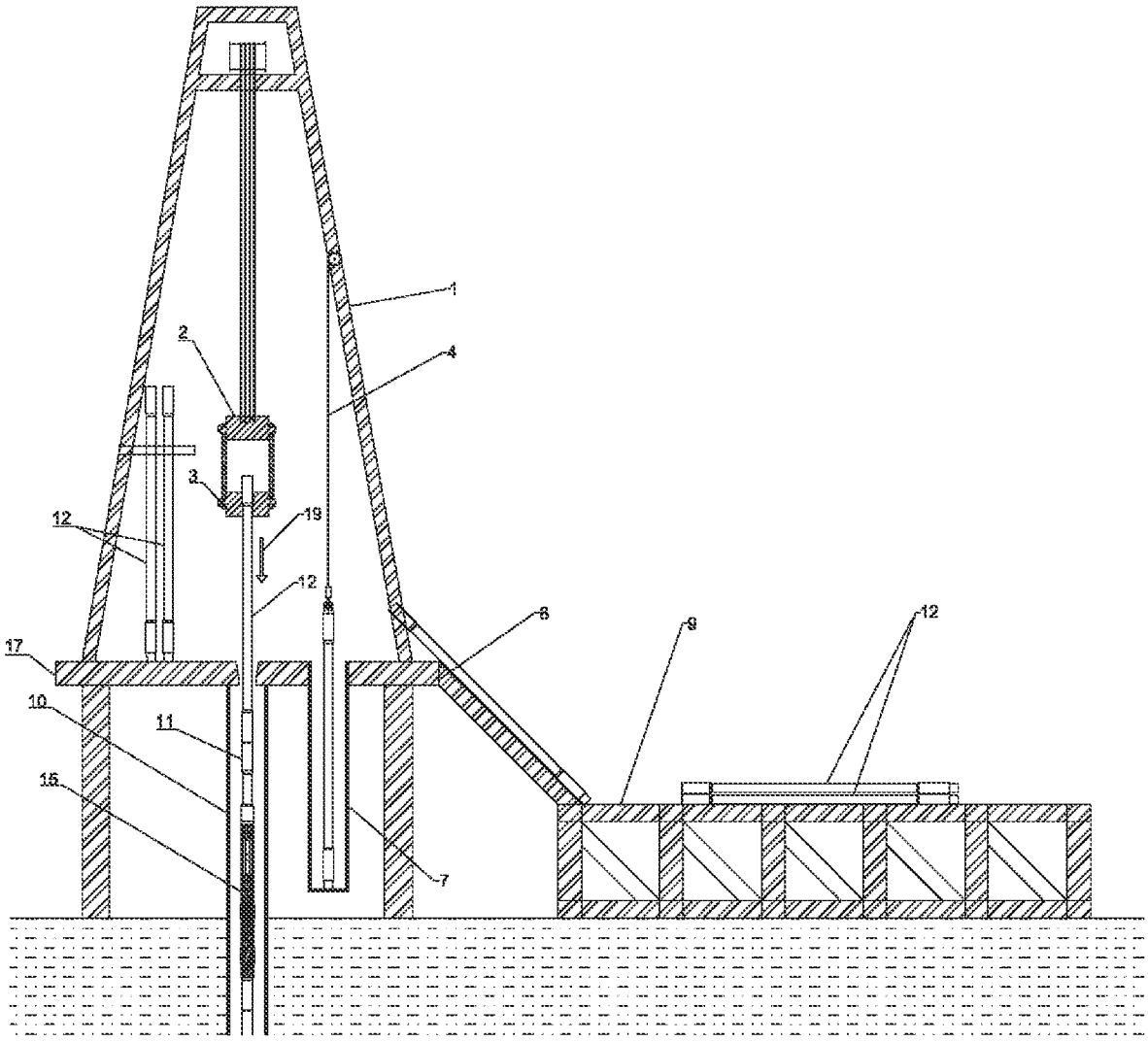
Figure 5:
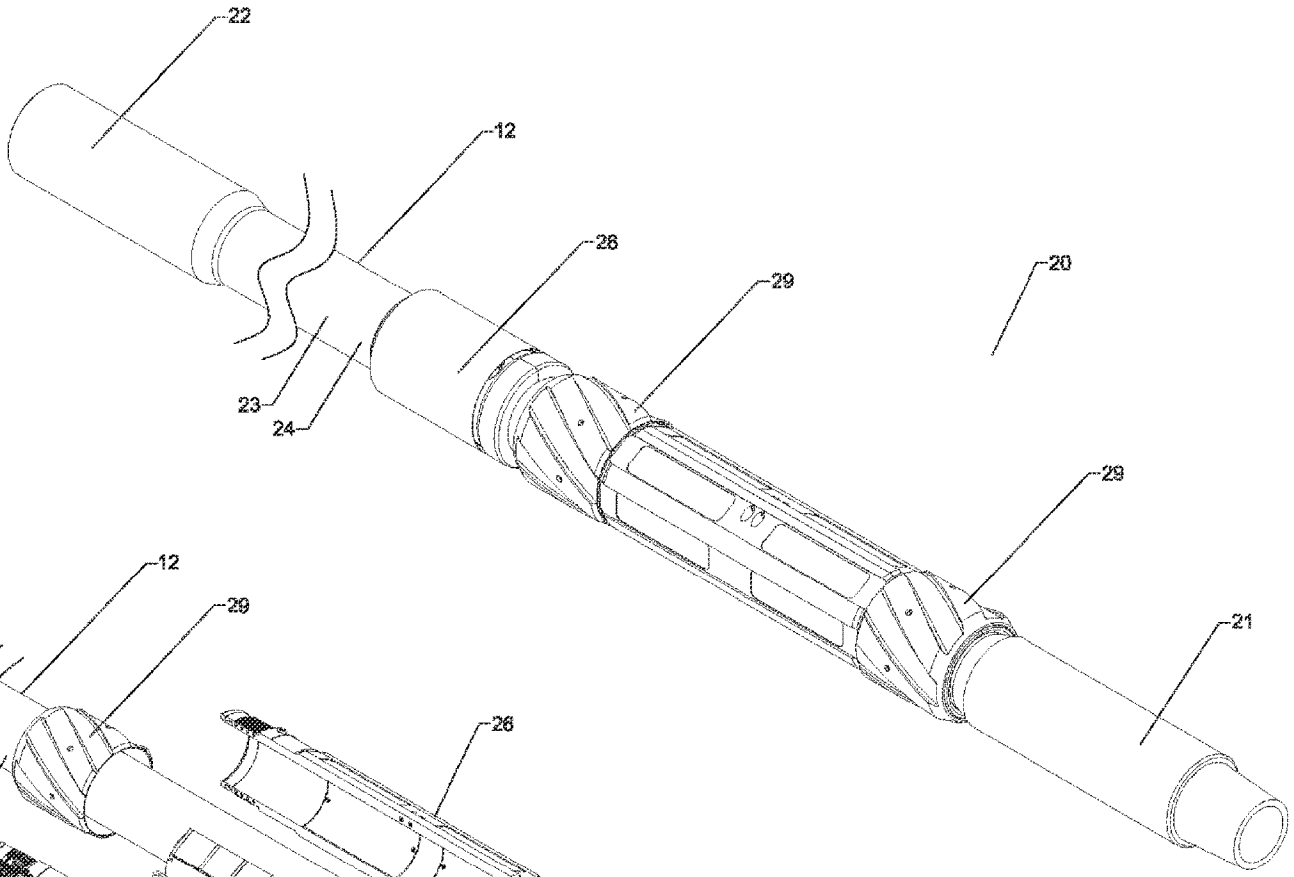
FIG. 5 is a perspective view of the preferred embodiment of the apparatus of the present invention.
Figure 6:
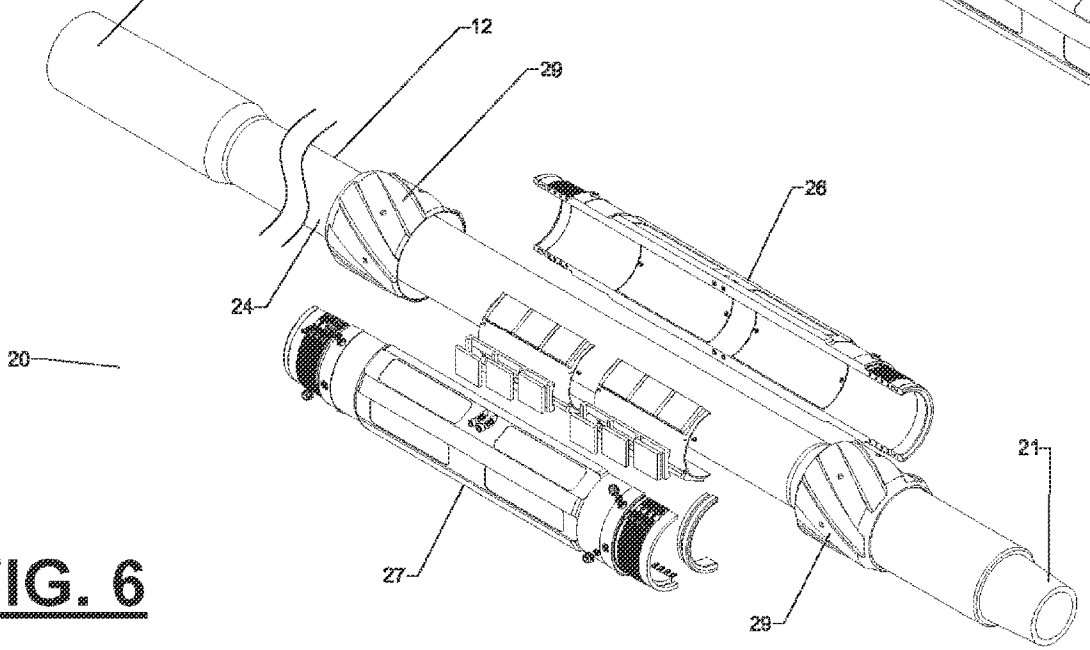
FIG. 6 is an exploded perspective view of the preferred embodiment of the apparatus of the present invention.

FIGS. 1-10 show the preferred embodiment of the apparatus of the present invention designated generally by the numeral 20 (see for example, FIGS. 2, 6). FIGS. 1-4 illustrate the method of the present invention. In FIGS. 1-4, a derrick 1 is shown having a block 2 and elevator 3. The derrick 1 can be provided with a tugger line 4. In FIGS. 1-3 there is shown a rotary table with slips designated by the numeral 5. Finger boards 6 and mouse hole 7 can be used to store individual drill pipe joints or sections 12. A mouse hole 7 can be used to store a drill pipe joint 12 that can then be lifted using tugger line 4 as shown in FIG. 1. Individual joints of drill pipe 12 are stored on catwalk 9. These joints 12 can be moved as indicated by arrows 13, 14 to Vee door 8 and then to the derrick platform 17. In FIGS. 1-4, a wellbore 10 is shown. Drill string 11 is shown being lowered into wellbore 10. The drill string 11 is comprised of drill pipe joints 12 connected end to end. In FIG. 1, the drill string 11 is supported by the rotary table with slips 5.

The tool apparatus 20 provides a tool assembly 15 which can be mounted to a standard, commercially available drill pipe joint or section 12 as will be described more fully hereinafter. In FIG. 1, arrows 13, 14 illustrate the travel of a drill pipe joint or section 12 from catwalk 9 to platform 17. FIGS. 2, 3 and 4 illustrate the travel path of a joint of drill pipe 12 fitted with tool assembly 15 as it travels from catwalk 9 (FIG. 2) to the platform 17 (see FIG. 3) and into the wellbore 10 (see FIG. 4). In FIG. 4, the tool assembly 15 mounted on a drill pipe joint or section 12 is shown as part of the drill string 11. FIG. 3 illustrates that the tool apparatus 20 (which includes the tool assembly 15 and a joint of drill pipe 12) can be placed in the mouse hole 7, or finger boards 6, or gripped by the block 2 and elevator 3 or placed in the mouse hole 7 prior to being lowed into wellbore 10.

FIGS. 5-10 show tool assembly 15 and tool apparatus 20 in more detail. The tool apparatus 20 is shown in FIGS. 5-10 with tool assembly 15 mounted to drill pipe joint or section 12 and more particularly to the cylindrically shaped portion 23, which has a cylindrical outer surface 24. Each drill pipe joint or section 12 can provide connector end portions 21, 22 such as a pin end portion 21 and a box end portion 22. In between the pin end portion 21 and the box end portion 22 is cylindrical portion 23 having cylindrically shaped outer surface 24 to which tool assembly 15 is attached.

In one embodiment, tool assembly 15 can be mounted to cylindrical portion 23 in between a connector end portion 21, 22 and a locking clamp 28 (see FIG. 5). However, it should be understood that the tool assembly 15 could be mounted in between a pair of locking clamps 28 which are both spaced away from either connector end portion 21 or 22.

Figure 7:
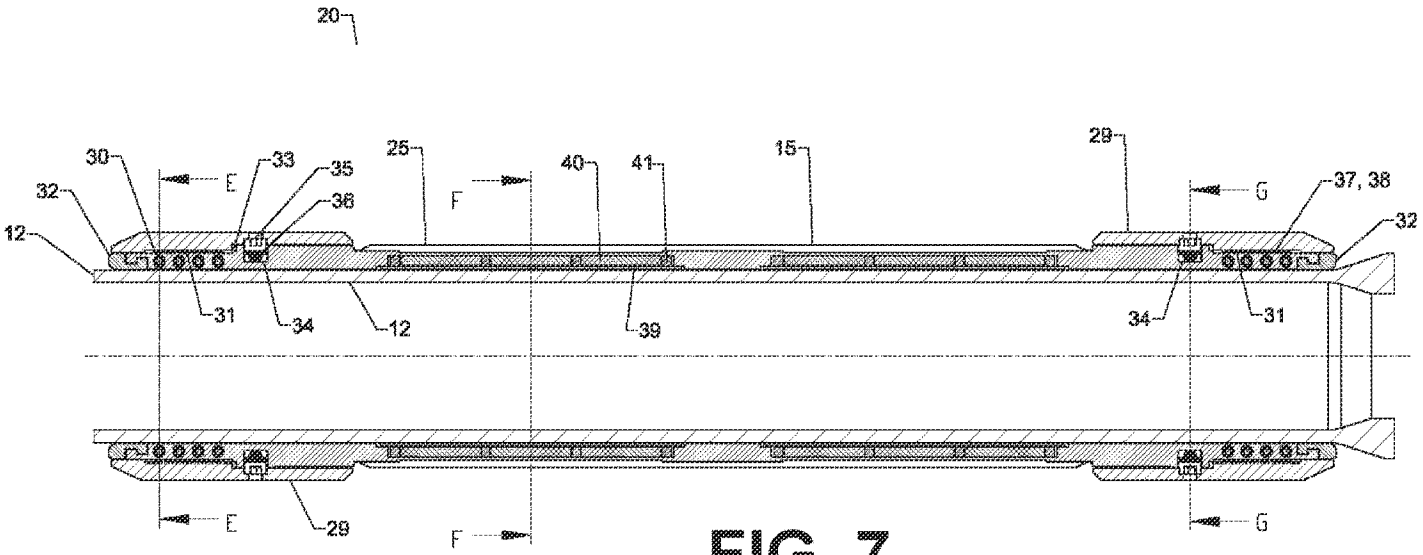
FIG. 7 is a partial sectional elevational view of the preferred embodiment of the apparatus of the present invention.
Figure 10:
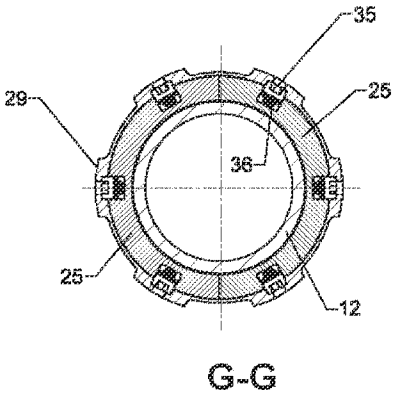
FIG. 10 is a sectional view taken along lines G-G of FIG. 7.

Tool assembly 15 provides a support sleeve 25. The support sleeve 25 has sleeve halves 26, 27 (see FIGS. 7-11). Centralizer rings 29 are provided at each end portion of support sleeve 25 and attached thereto with threaded connections 31. The sleeve halves 26, 27 can be connected together using bolts or bolted connections 30. In FIG. 7, split bearings 32 are shown attached to each end portion of support sleeve 25. Compression springs 33 are provided in between support sleeve 25 and centralizer ring 29 at each end portion of tool assembly 15. One or more recesses or sockets 34 are provided in between each centralizer ring 29 and support sleeve 25. These recesses or sockets 34 are receptive of conical spring 36 and grub screw 35. The grub screw 35 can be tightened to occupy recess or socket 34 of sleeve 25.

Once centralizer ring 29 is threaded upon the external threads 37 of support sleeve 25, a threaded connection 31 is perfected between centralizer ring 29 and support sleeve 25. Grub screw 35 is spring loaded using conical spring 36. After the threaded connection 31 is perfected, the grub screw 35 can be backed out slightly to engage a correspondingly shaped recess or socket 43 on centralizer ring 29 (see FIGS. 7, 11). The threaded connection 31 is thus perfected by engaging the external threads 37 of sleeve 25 with the internal threads 38 of centralizer ring 29.

Figure 9:
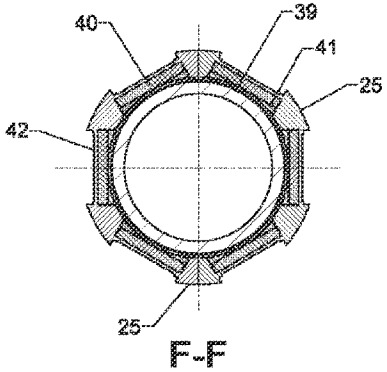
FIG. 9 is a sectional view taken along lines F-F of FIG. 7.
Figure 8:
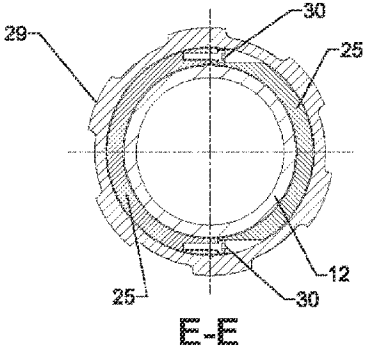
FIG. 8 is a sectional view taken along lines E-E of FIG. 7.
Figure 11:
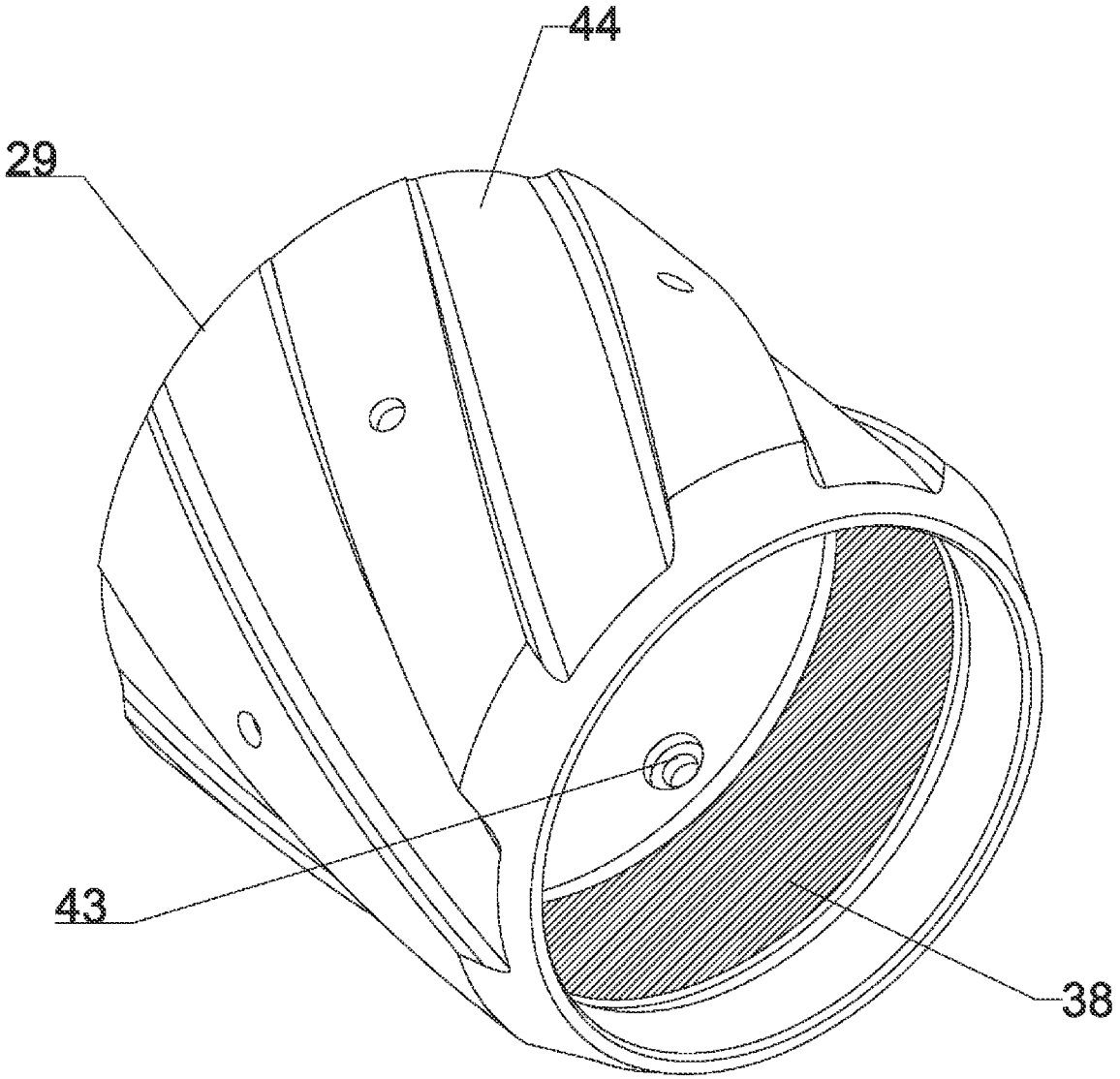
FIG. 11 is a partial perspective view of the preferred embodiment of the present invention showing a centralizer ring.

A plurality of magnets 40 are mounted to magnet spacers 41 and magnet internal support sleeve 39. The support sleeve 25 has minimal thickness sections 42 that cover the magnets 40 as shown in FIG. 9.

Figure 13:
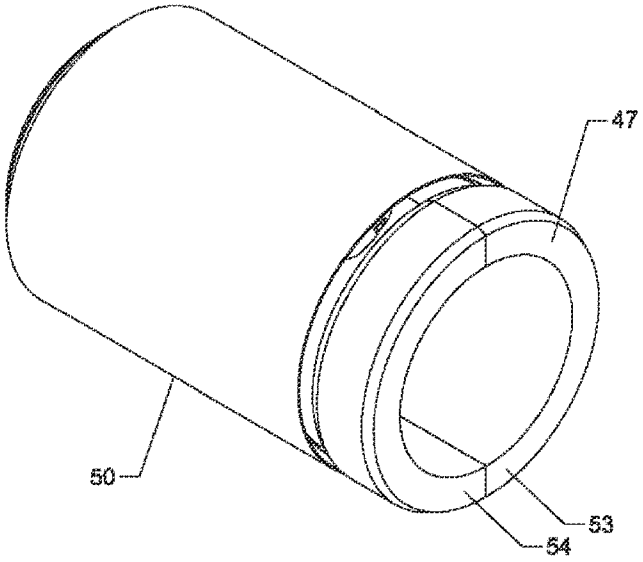
FIG. 13 is a perspective view of the locking clamp of FIG. 12.
Figure 15:
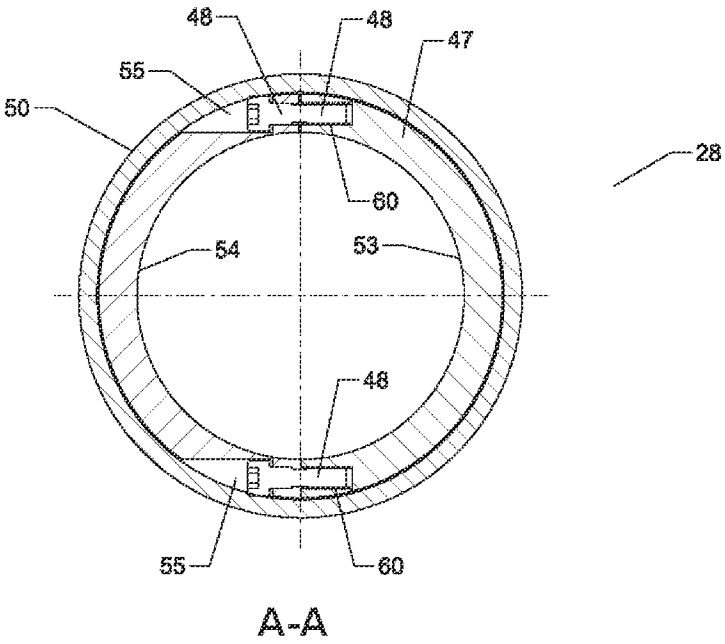
FIG. 15 is a sectional view taken along lines A-A of FIG. 13.
Figures 16, 17, 18:
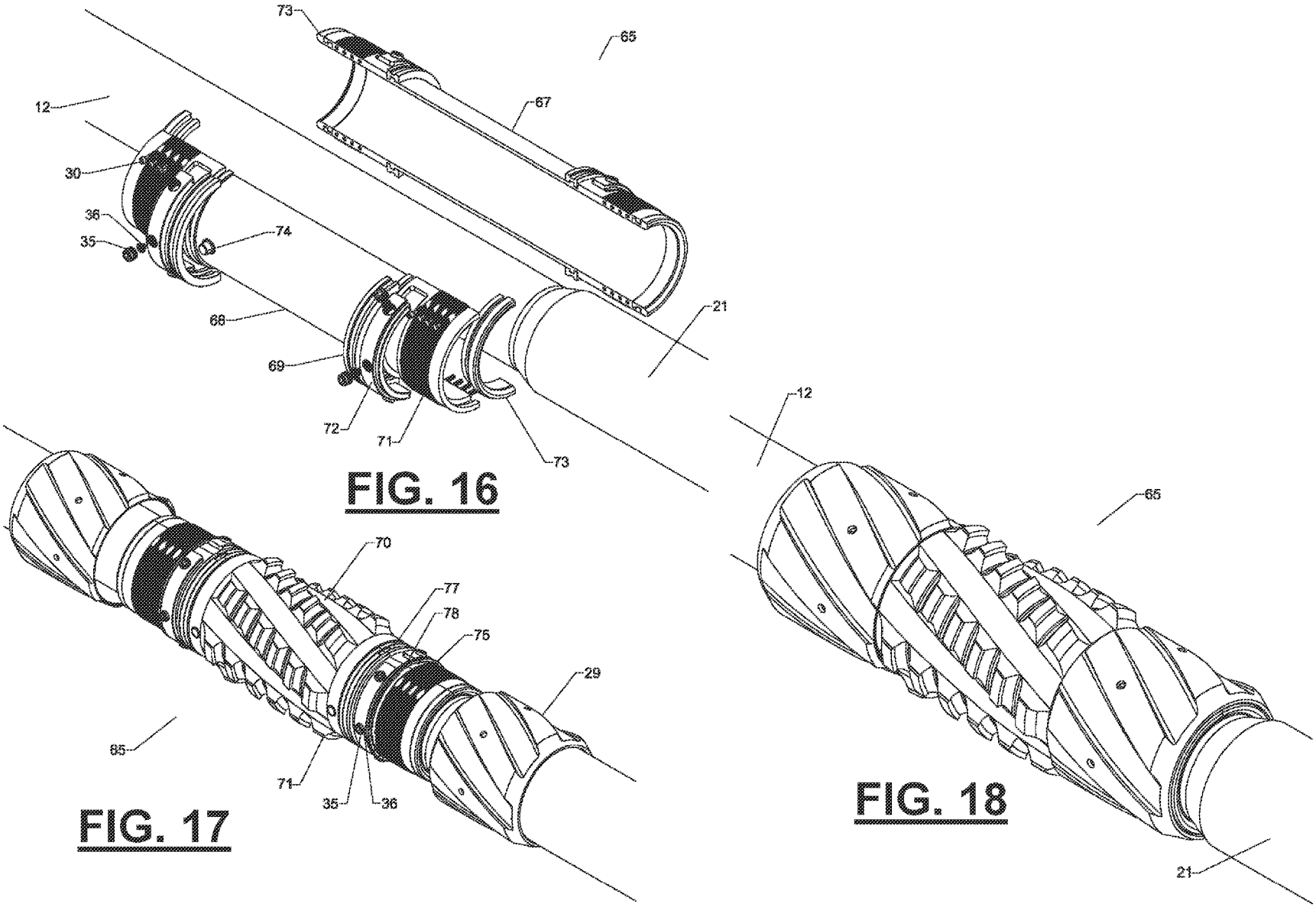
FIG. 16 is an exploded perspective view of the preferred embodiment of the apparatus of the present invention showing the debris removing tool in the form of a mountable scraper.
FIG. 17 is an exploded perspective view of the preferred embodiment of the apparatus of the present invention illustrating a mountable scraper tool.
FIG. 18 is a perspective view of the mountable scraper tool of FIGS. 15 and 16.
Figure 21:
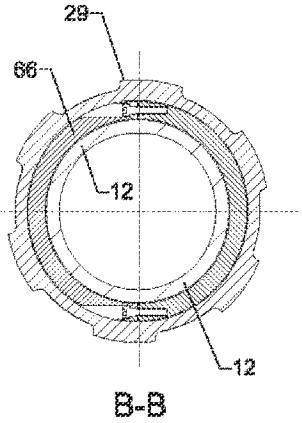
FIG. 21 is a sectional view taken along lines B-B of FIG. 19.
Figure 20:
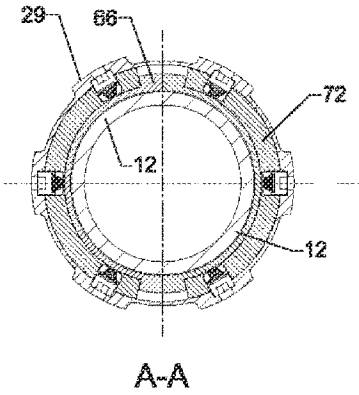
FIG. 20 is a sectional view taken along lines A-A of FIG. 19.
Figure 19:
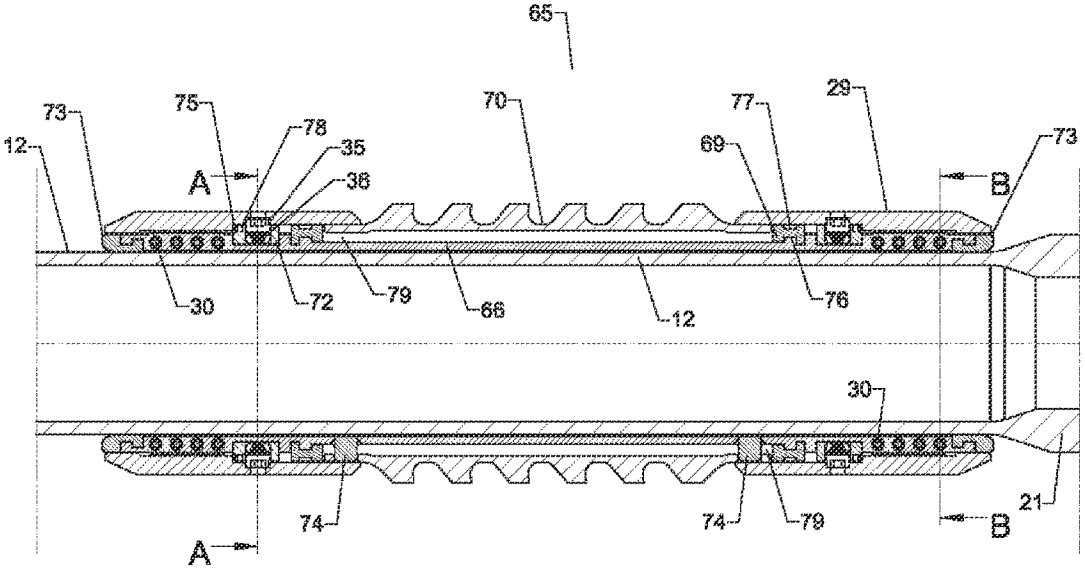
FIG. 19 is a sectional view of the mountable scraper tool of FIGS. 16 through 18.

FIGS. 13-18 show locking clamp 28 in more detail. Locking clamp 28 has a plurality of slip segments 45 that are circumferentially spaced around pipe joint 12 cylindrical portion 23. A split cone ring 46 provides two portions that engage and surround the plurality of slip segments 45 as shown in FIGS. 13, 15 and 17. A split slip ring 47 can be a two part ring that forms a connection at interlocking connection 56 with each slip segment 45. Thus, each slip segment 45 is installed into a mating groove of the split slip ring 47 as shown. Bolted connections or bolts 48 connect the segments 53, 54 of the split slip ring 47 together. Each of the segments 53, 54 has openings 55 that receive bolts or bolted connections 48 and internally threaded openings 60 that engage the threaded end portion of a bolt 48 as shown in FIGS. 13-14, 16 and 18.

Figure 12:
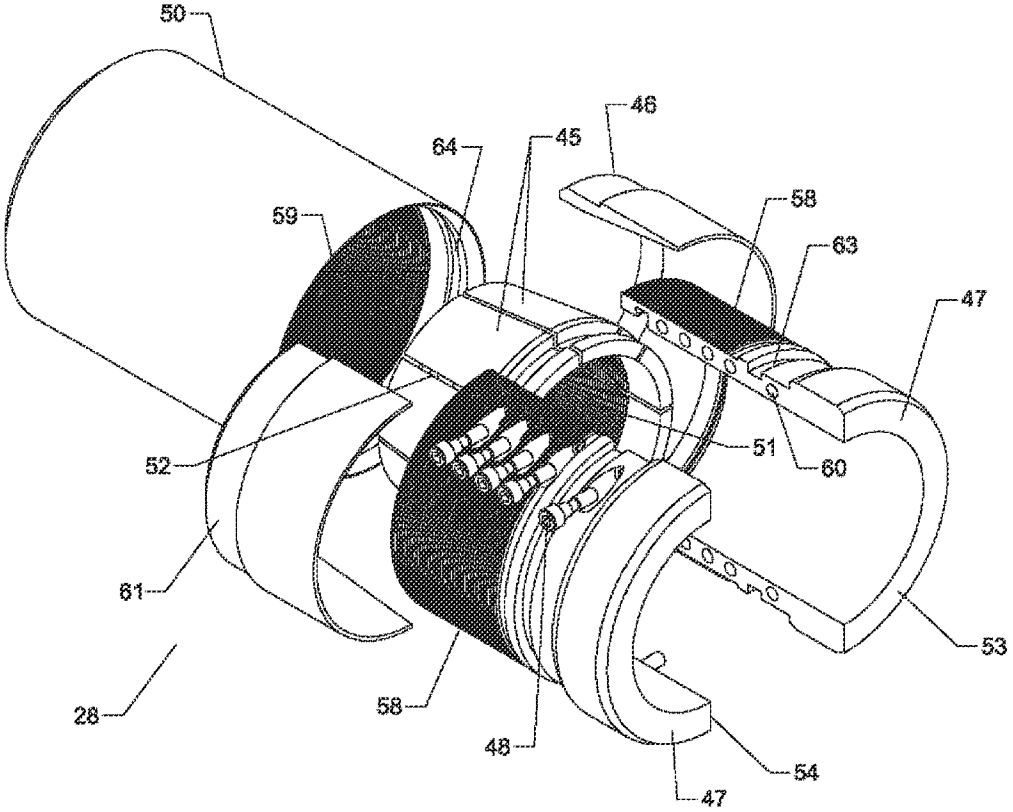
FIG. 12 is a partial exploded perspective view of the preferred embodiment of the apparatus of the present invention showing a locking clamp.

A snap ring 49 is placed in between split slip ring 47 and tensioner sleeve 50. Annular grooves can be provided on the outside surface of split slip ring 47 and on the inside surface of tensioner sleeve 50. In FIG. 13, the numeral 63 designates the annular groove on the outside surface of each segment 53, 54 of split slip ring 47. In FIG. 12, the numeral 64 designates the annular groove 64 on the inside surface of tensioner sleeve 50.

Figure 14:
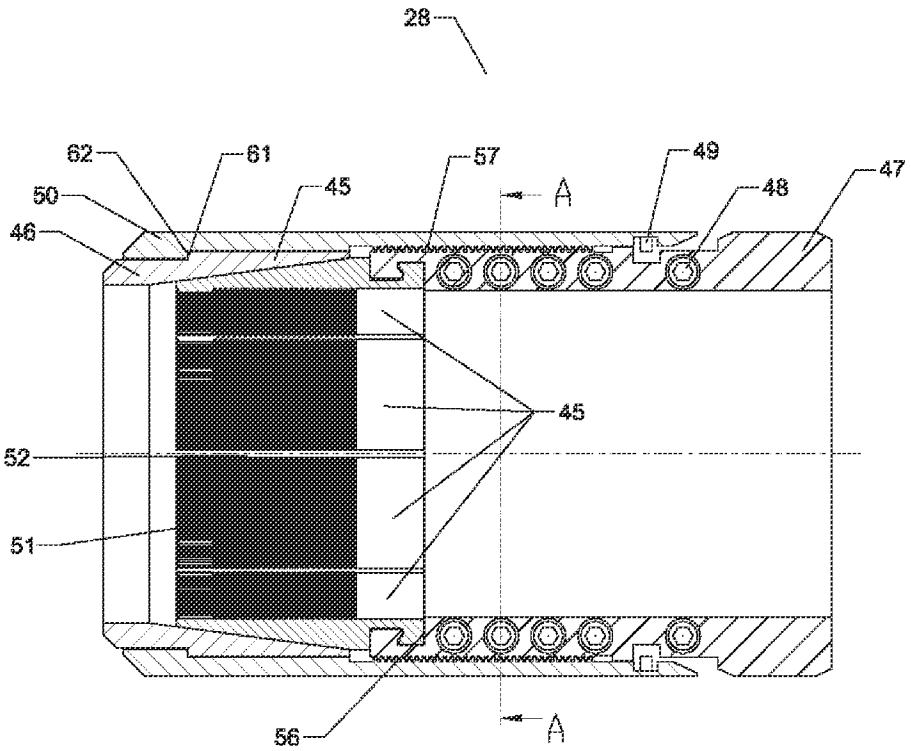
FIG. 14 is a sectional view of the locking clamp portion of the preferred embodiment of the apparatus of the present invention.

Each of the slips or slip segments 45 has an inner toothed portion 51 that grips the cylindrical outer surface 24 of cylindrical portion 23 of drill pipe joint 12. A gap 52 is provided in between each of the slip segments 45 (see FIG. 12). A threaded connection 57 is formed between the external threads 58 of split slip ring 47 and the internal threads 59 of tensioner sleeve 50. Correspondingly shaped and sized annular shoulders are provided on split cone ring 46 and tensioner sleeve 50. In FIG. 14, split cone ring 46 has annular shoulder 61. Tensioner sleeve 50 has annular shoulder 62.

Figure 22:
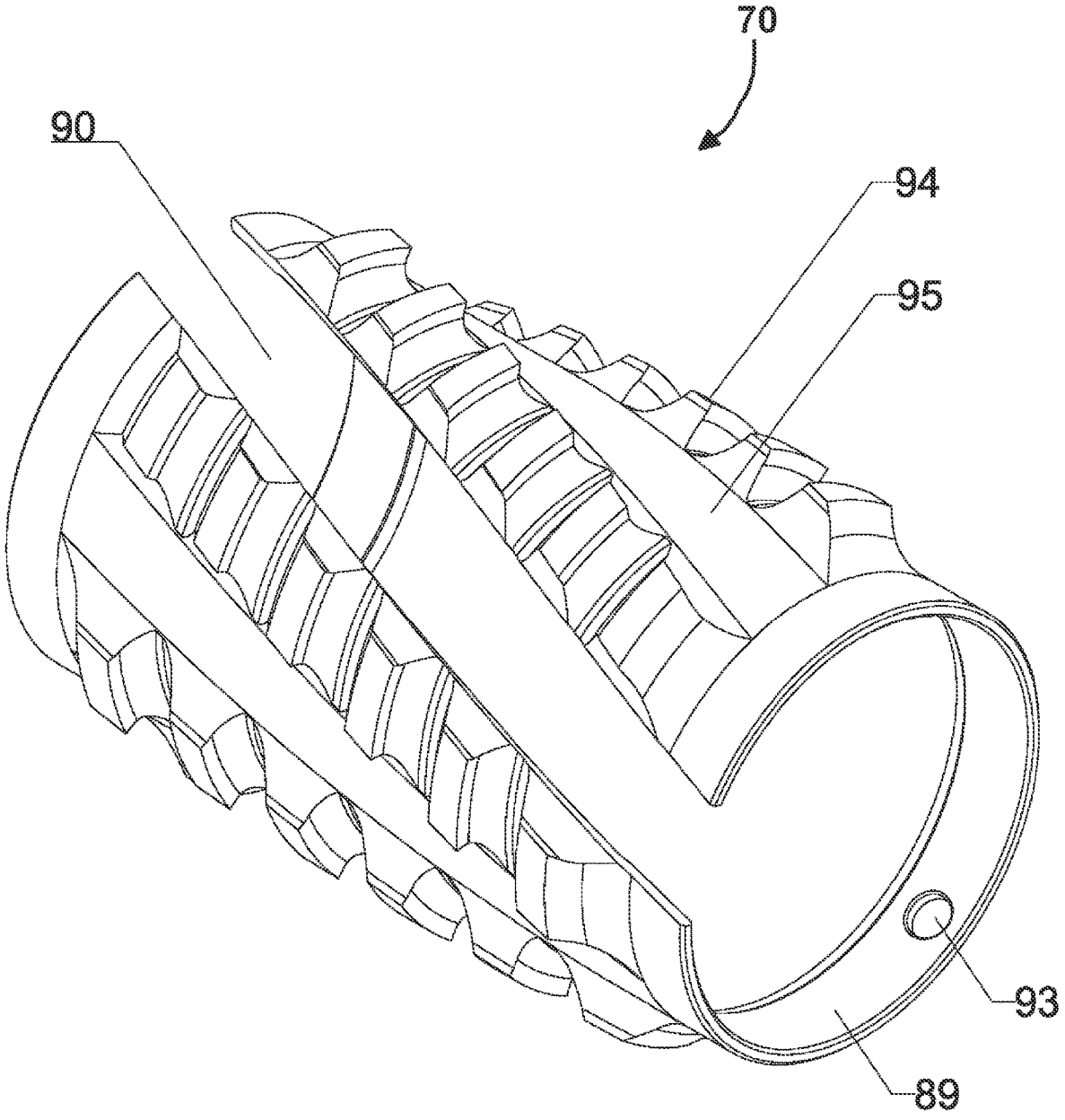
FIG. 22 shows a perspective view of a preferred scraper broach.

FIGS. 16-22 show a scraper or broach tool designated generally by the numeral 65. FIG. 22 shows perspective views of a scraper broach 70. As with the preferred embodiment, the scraper tool 65 provides a support sleeve 66 which can be a split support sleeve having sleeve halves 67, 68. External split bearings 69 attach to the support sleeve 66 as shown in FIGS. 22 and 25. Centralizer rings 29 connect to the support sleeve 66 with threaded connections as with the preferred embodiment. The support sleeve 66 thus provides external thread 71 (see FIG. 17). The centralizer rings 29 provide internal threads 38 (see FIG. 11). A scraper or broach 70 is a cleaning member that attaches to the outer surface of support sleeve 66, being held in position by the centralizer rings 29 which overlap it as seen in FIGS. 22 and 25. C-rings 72 are provided in between support sleeve 66 and centralizers 29 as shown. Also provided between centralizer rings 29 and support sleeve 66 are spring support ring 78 and compression spring 75. As with the preferred embodiment, grub screws 35 and conical springs 36 can be used to complete the connection between the centralizer ring 29 and support sleeve 66. External split bearings 69 form an interlocking connection with support sleeve 66 at interlocking connection 76. Snap ring 77 can be placed in between external split bearing 69 and centralizer 29.

Pins 74 attaches to sleeve 66 and to broach or scraper 70 as shown in FIGS. 19 through 22. Pins 74 attached to corresponding holes 93 on scraper broach 70. Pins 74 are attached to the support sleeve 66 by welding and become an integral part of the support sleeve 66.

FIGS. 22-26 show various scraper and brush type broaches. In FIG. 24, three different configurations of longitudinal cuts are shown for a broach 89. These can include helical longitudinal cut 90, straight longitudinal cut 91 and tortuous longitudinal cut 92. FIG. 24 shows a brush type broach 89. FIG. 25 illustrates a concentric ID for the broach 89 whereas FIG. 26 shows an eccentric ID for the broach 89. In FIG. 22, the broach 89 is shown having a mating hole 93 for a pin 74, scraper teeth 94 and helical bypass grooves 95. The longitudinal cut 90 is shown in FIG. 22. However, it should be understood that the FIG. 22 configuration could have the straight longitudinal cut 91 or the tortuous longitudinal cut 92 of FIG. 23.

Figure 28:
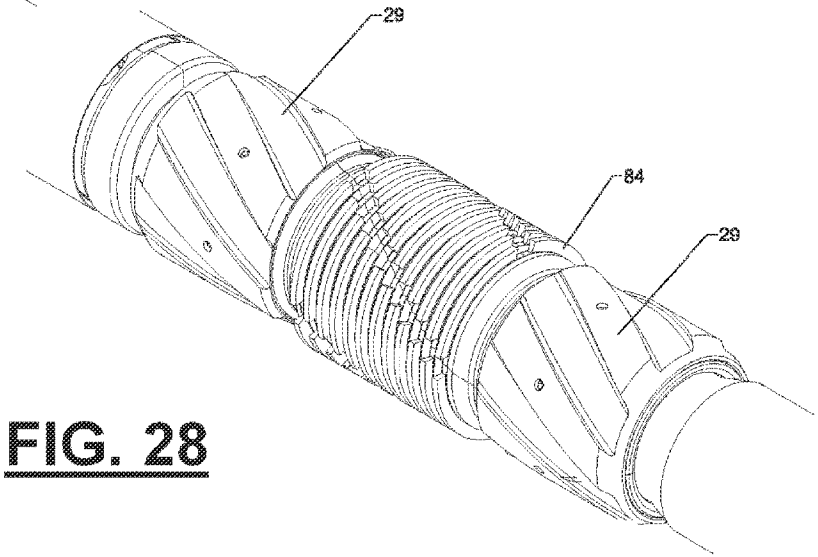
FIG. 28 is a perspective view of the preferred embodiment of the apparatus of the present invention showing a mountable brush tool.
Figure 27:
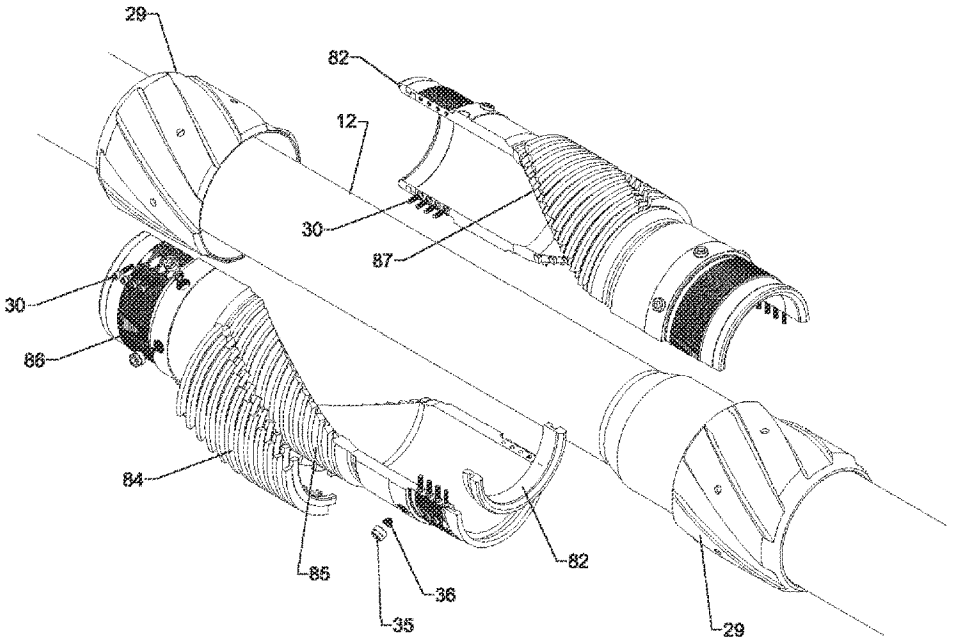
FIG. 27 is an exploded perspective view of the preferred embodiment of the apparatus of the present invention showing a mountable brush tool.
Figure 31:
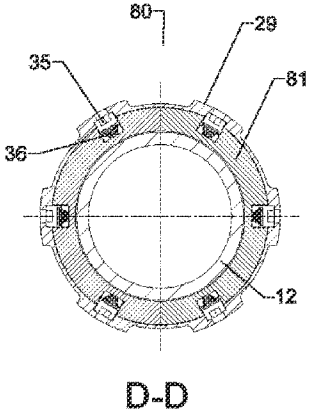
FIG. 31 is a sectional view taken along lines D-D of FIG. 29.
Figure 30:
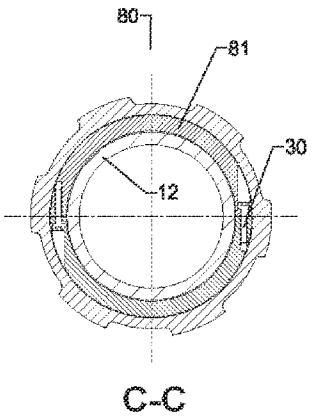
FIG. 30 is a sectional view taken along lines C-C of FIG. 29.
Figure 29:
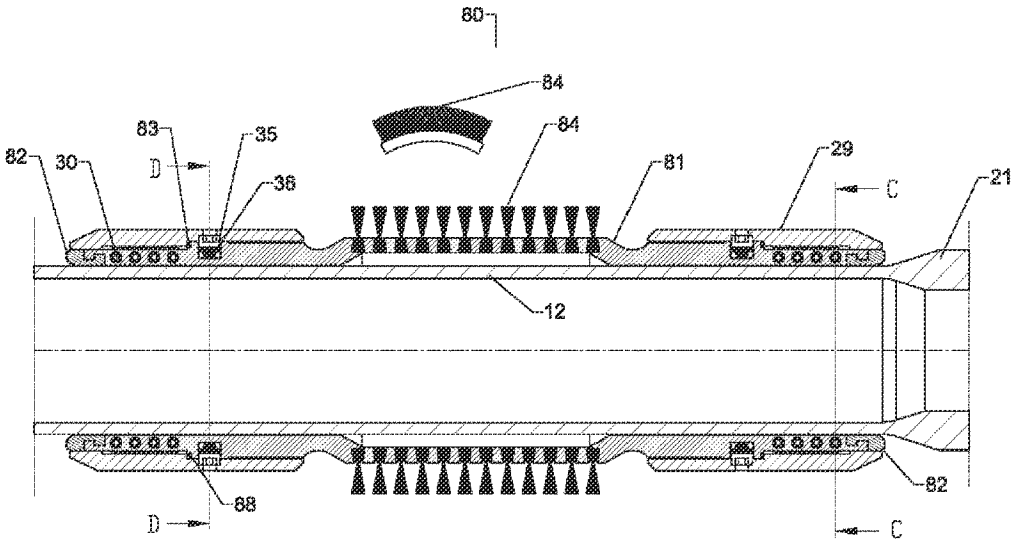
FIG. 29 is a sectional view of the mountable brush tool of FIGS. 27 and 28.

FIGS. 27-31 show a brush tool 80 that can be used to brush the wellbore. Brush tool 80 provides a support sleeve 81 that has a helical split 87 as shown in FIG. 27. Support sleeve 81 has split bearings 82 at its end portion (see FIG. 29). Each end portion of support sleeve 81 has external threaded sections 86 for forming a connection with a centralizer ring 29 as with the earlier embodiments (see FIG. 27). Grub screws 35 and conical springs 36 can be used to form a connection between the support sleeve 81 and centralizer ring s 29 as shown in FIGS. 23 and 25. Compression spring 83 is placed in between centralizer ring 29 and sleeve 81 at interlocking connection 88 which can be in the form of correspondingly shaped annular shoulders provided on both the sleeve 81 and centralizer 29. Compression spring 83 is provided in between the annual shoulders at the interlocking connection 88 as shown in FIG. 29.

A plurality of brush segments 84 are mounted to support sleeve 81 at provided mating grooves 85 (see FIGS. 28 and 29).

Figure 32:
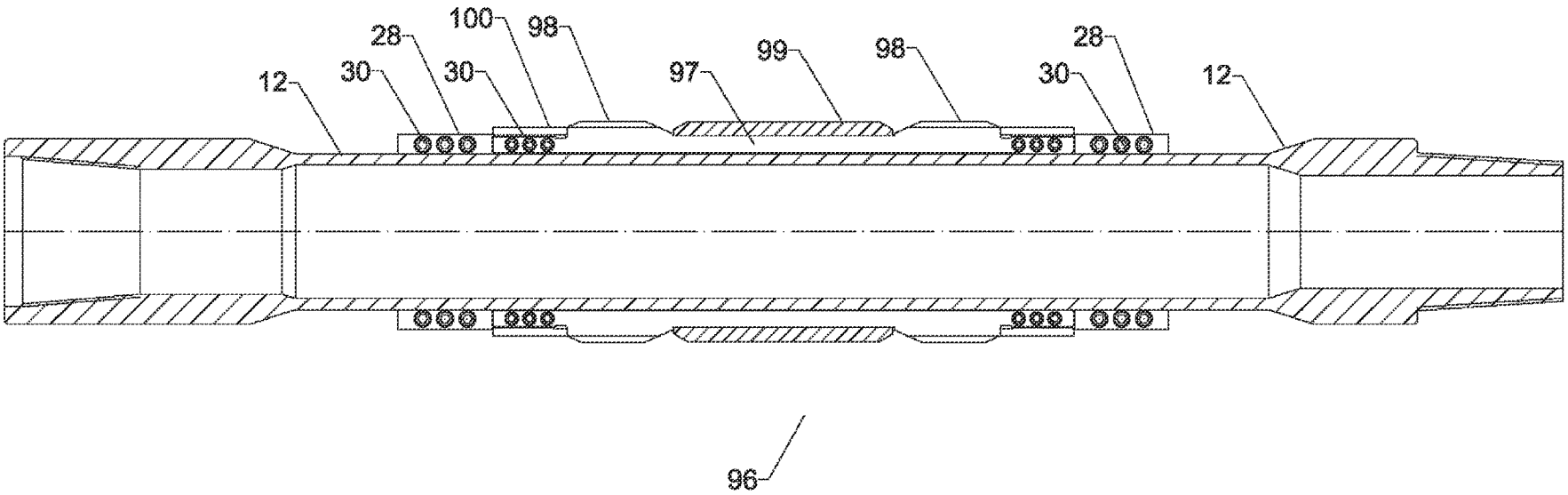
FIG. 32 is a sectional view showing an alternate embodiment where the centralizers are an integral component of the split housing.

FIG. 32 provides a sectional view of a wellbore cleaning tool having integral centralizers which are non-rotating. The well cleaning tool 96 of FIG. 32 is shown mounted to drill pipe section 12. The well cleaning tool 96 provides a split housing or split support sleeve 97 having integral centralizers 98. Cleaning members 99, such as a brush, scraper and/or magnet are mounted to the split housing or support sleeve 97. External rings 100 are provided. The split housing or split support sleeve 97 is placed on drill pipe 12 in between locking clamps 28.

Figure 33:
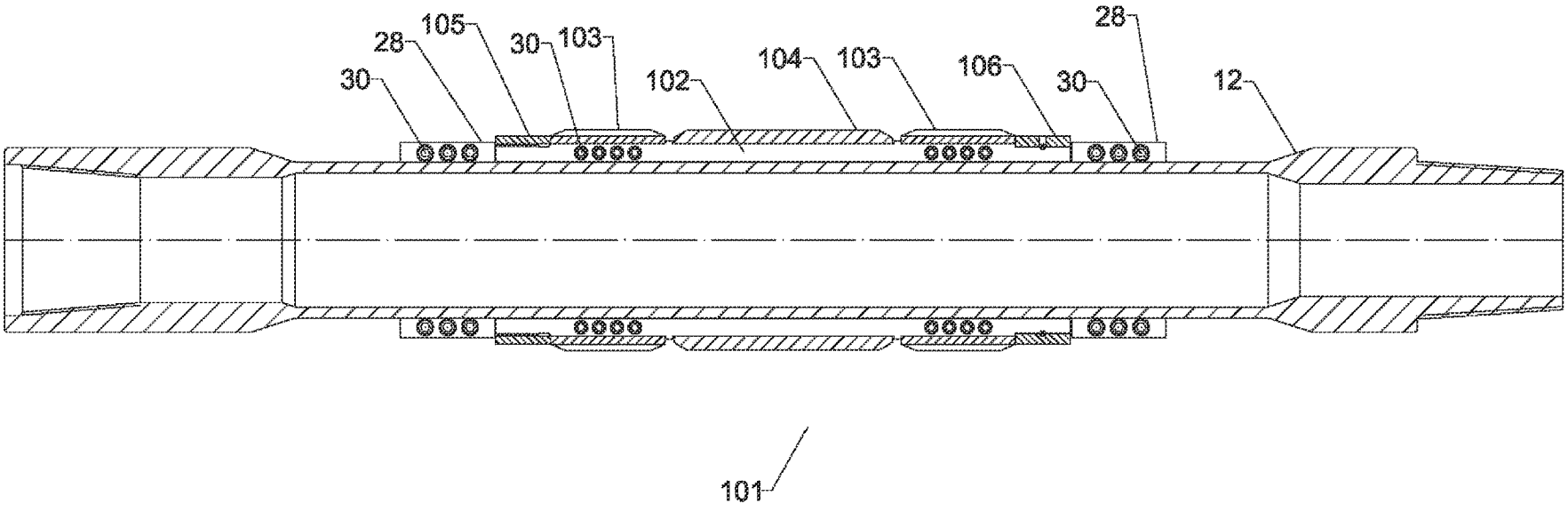
FIG. 33 is another alternate embodiment with free rotating centralizers and different locking methods.

FIG. 33 shows an additional embodiment of the apparatus of the present invention which provides free rotating centralizers or centralizer rings 103. Well cleaning tool 101 has a split housing 102 to which is affixed cleaning members 104. Bolted connections 30 can be used to secure the halves of the split housing together as with the preferred and other embodiments. The centralizer rings 103 engage the outer surface of the split housing 102 and are held in position with a locking ring 105 or 106. The locking ring 105 is a threaded type that engages threads provided on the split housing 102. The locking ring 106 is a lock wire type. Cleaning members 99, such as a brush, scraper and/or magnet are mounted to the split housing or support sleeve 97.

Figure 34:
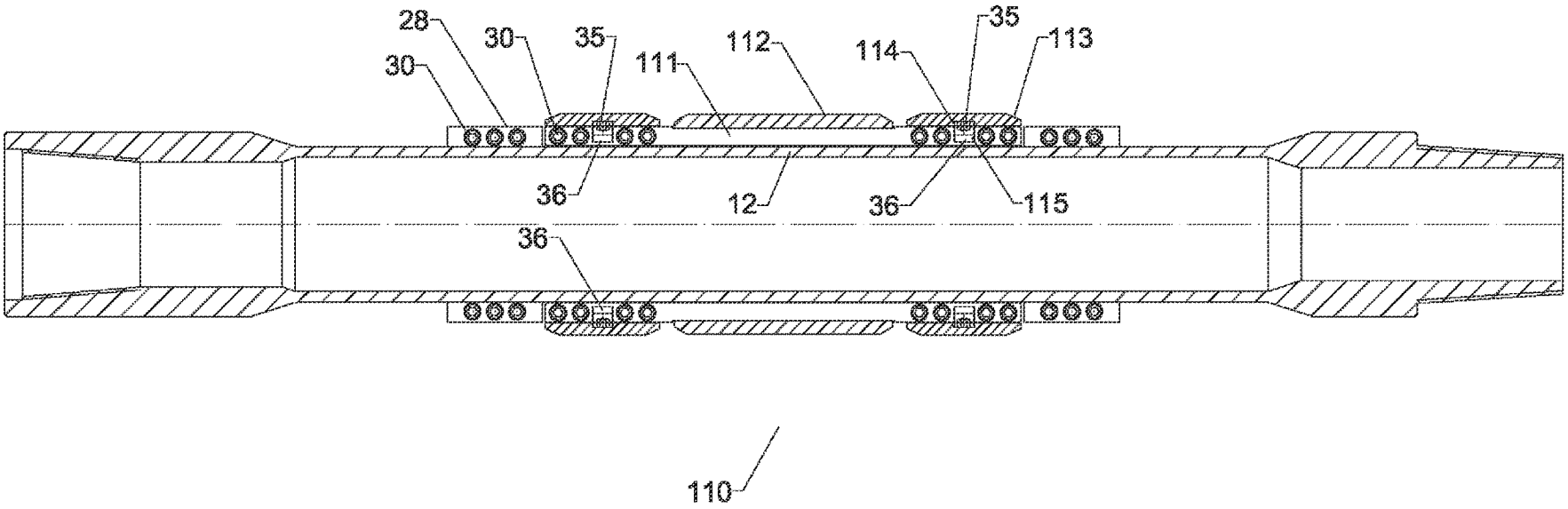
FIG. 34 is a sectional view showing an alternate centralizer that is attached with grub screws.

FIG. 34 shows a well cleaning tool designated generally by the numeral 110. The well cleaning tool 110 provides centralizers that are attached with grub screws 35. In FIG. 34, split housing 111 carries cleaning members 112. External rings 113 are secured to split housing 111 using grub screws 35 and conical springs 36. Split housing 111 can provide a recess or socket portion 114 that aligns generally with the recessed or socket portion 115 on external ring 113. The aligned recesses or sockets 114, 115 can be occupied with a grub screw 35 and conical spring 36.

Figure 35:
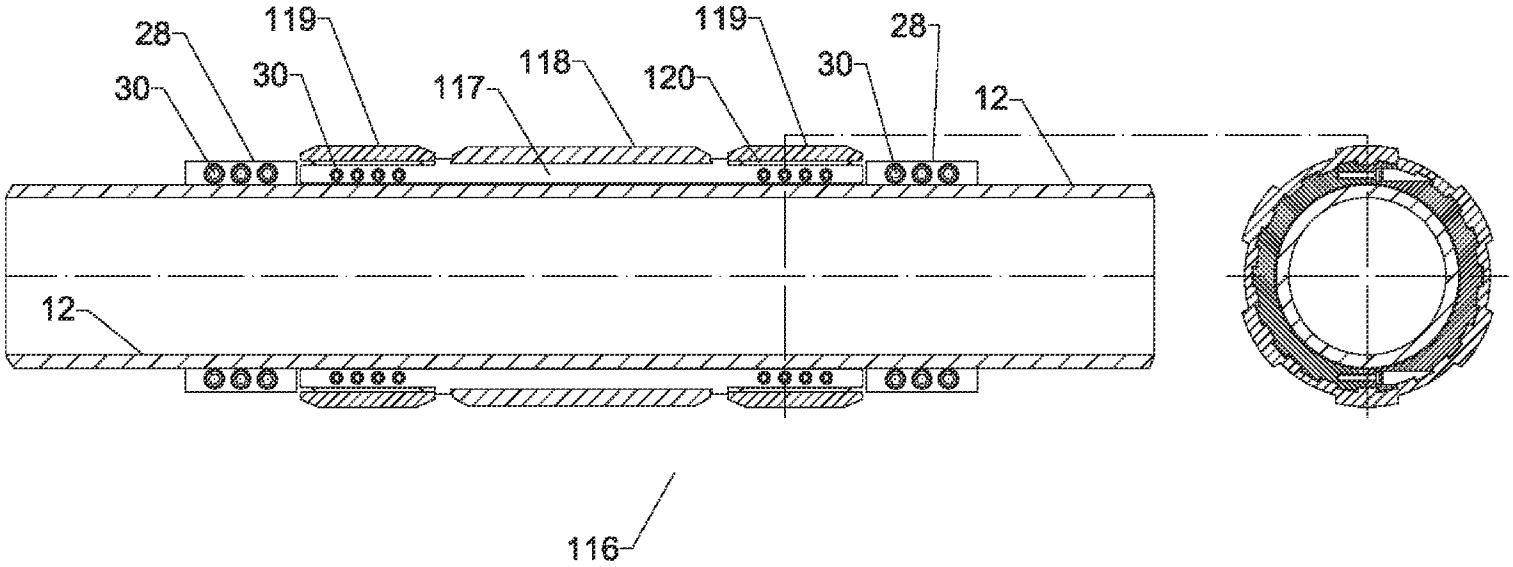
FIG. 35 is a sectional view showing centralizers attached with a spline.

FIG. 35 shows a well cleaning tool 116 wherein centralizers are attached with a spline. In FIG. 35 there is provided well cleaning tool 116 which has a split housing 117 that carries a plurality of cleaning members 118. External centralizer rings 119 are attached to split housing 117 with splines 120. Locking clamps 28 are placed on either side of split housing 117 to maintain its position upon drill pipe joint 12.

Figures 36A, 36B, 36C:
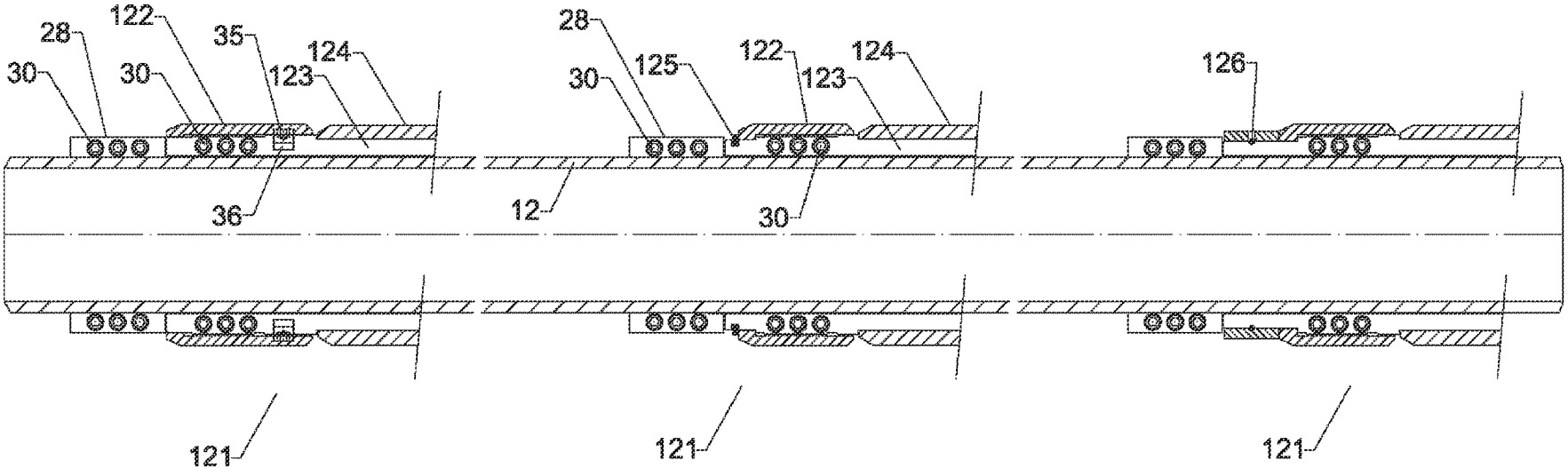
FIGS. 36A-36C are sectional views showing various secondary attachment methods.

FIGS. 36A through 36C show a well cleaning tool 121 with various secondary attachment methods. FIG. 36A shows a version of the secondary attachment method of the external ring to the slip housing using grub screws. FIG. 36B shows a version of the secondary attachment method of the external ring to the slip housing using a snap ring. FIG. 36C shows a secondary attachment method of the external ring to the slip housing using a locking ring and lock wire. In FIGS. 36A, 36B, and 36C there are seen split housing 123, external rings 122, cleaning members 124 and locking clamps 28. Bolted connections 30 are also shown for holding the locking clamp 28 to the drill pipe 12 as well as for securing the split housing 123 to the drill pipe 12.

In FIG. 36A, the secondary attachment method is in the form of grub screws 35. The grub screws 35 can be provided with conical springs 36.

In FIG. 36B, the secondary attachment method of the external ring 122 to the slip housing 123 using a snap ring 125.

In FIG. 36C, the second method of attaching the external ring to the slip housing uses a locking ring and lock wire 126.

Figures 37A, 37B, 37C:
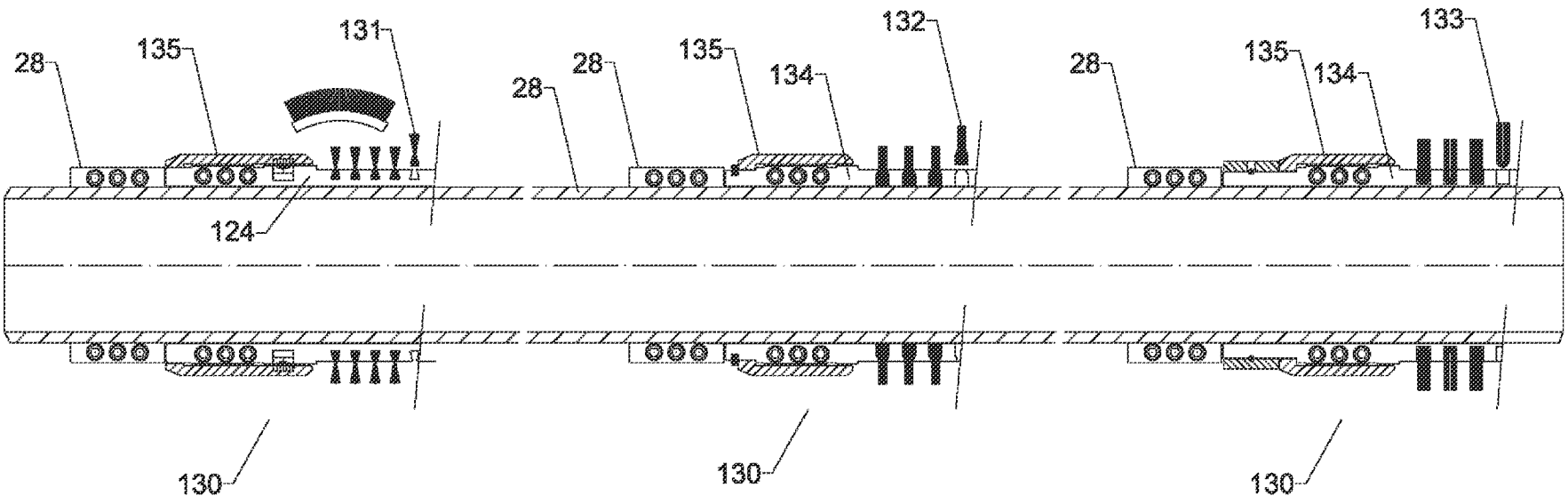
FIGS. 37A-37C are sectional views showing various brush insert attachment methods.

FIGS. 37A through 37C show various brush insert and attachment methods on a well cleaning tool 130. In FIG. 37A, a dove tail groove and crimped style brush insert is shown designated as 131. In FIG. 37B, a crimped bullet style brush insert is designated by the numeral 132. In FIG. 37C, a stuffed style brush insert is shown, designated by the numeral 133. In each of the FIGS. 37A, 37B, there can also be seen locking clamp 28, a split housing 134 and external centralizer rings 135. It should be understood that any of the brush inserts of FIGS. 37A, 37B, 37C can be used with any embodiment of the brush tool.

Figure 38:
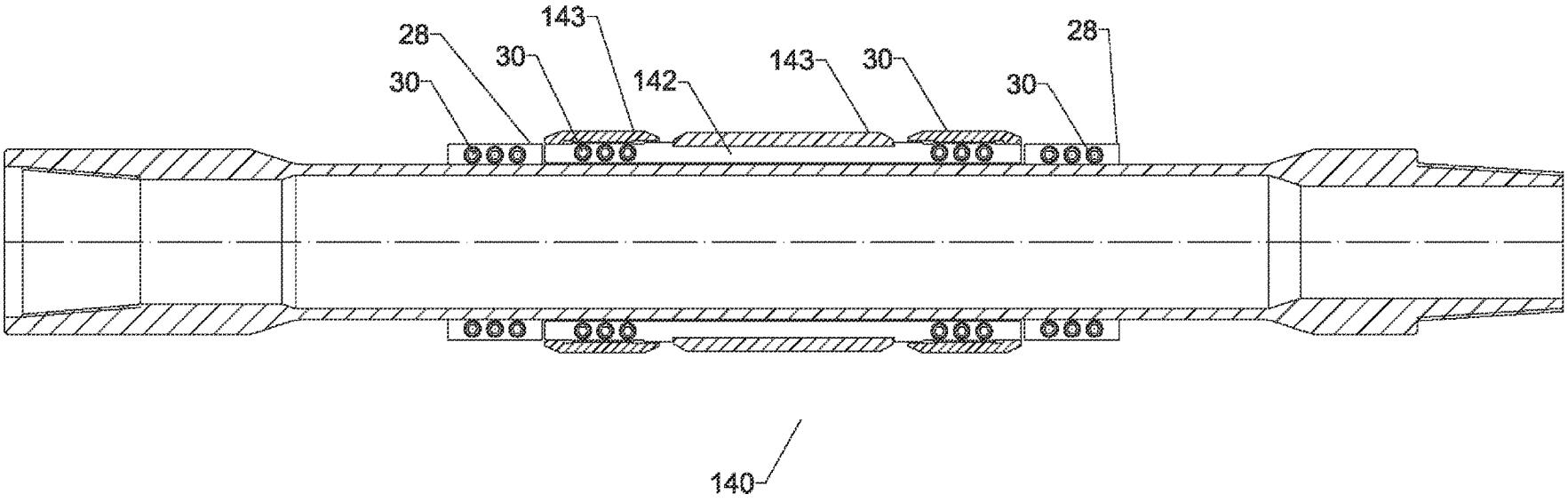
FIG. 38 is a sectional view showing a generic mountable well brush cleanup tool having a split housing.

FIG. 38 shows a generic mountable wellbore cleaning tool designated by the numeral 140. The well cleaning tool 140 provides a split housing 141, cleaning member or members 142, external rings 143, locking clamps 28 and bolts or bolted connections 30.

Figure 40:
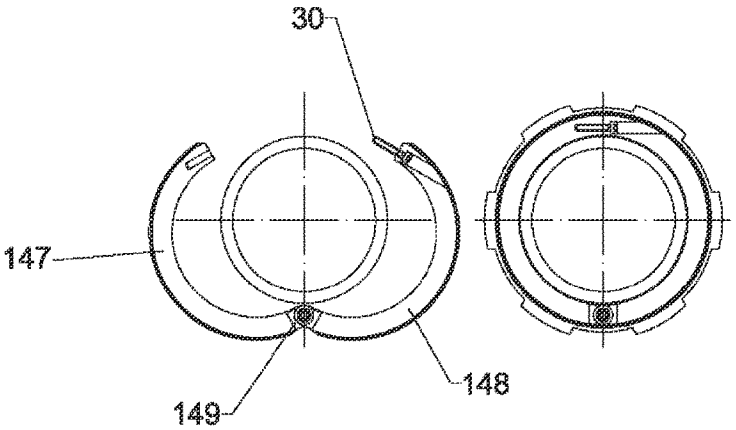
FIG. 40 is an end view showing a cleanup tool having a hinged housing.
Figure 39:
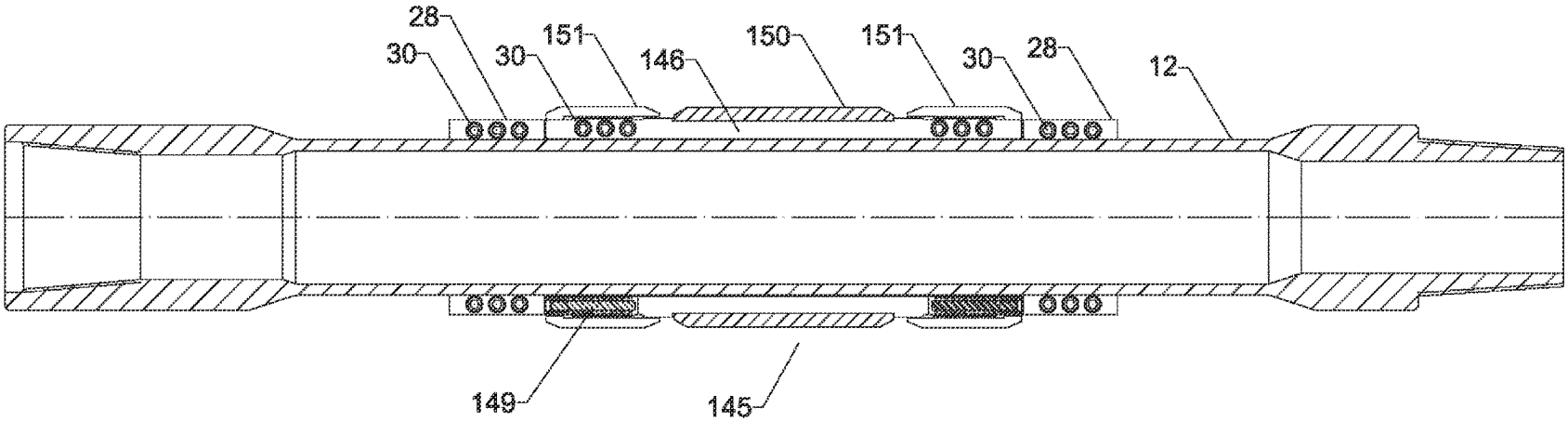
FIG. 39 is a sectional view showing a cleanup tool having a hinged housing.

FIGS. 39 and 40 show the well cleaning tool that provides a hinged housing. Well cleaning tool 145 is attached to a section of drill pipe 12 using split housing 146 that includes a pair of halves 147, 148. The split housing halves 147, 148 are pivotally attached at hinge 149 and are connectable using bolted connections 30. As with other embodiments, the well cleaning tool 145 provides cleaning members 150, external rings 151, bolted connections 30, and locking clamps 28.

Figure 41:
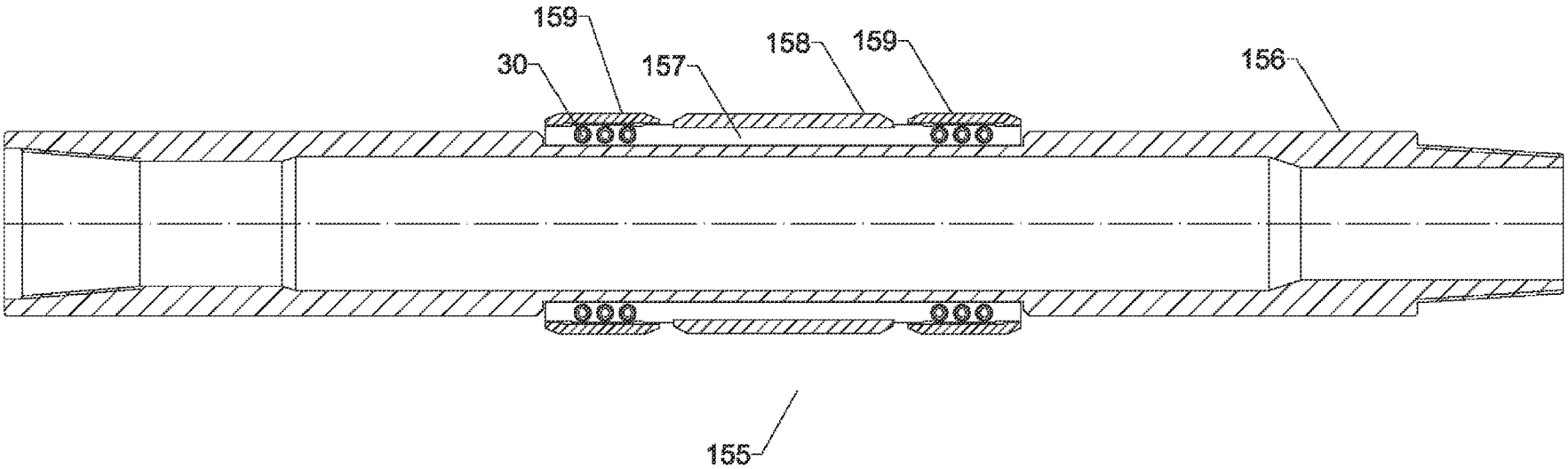
FIG. 41 is a sectional view of a wellbore cleanup tool having a customized tool mandrel.

FIG. 41 shows a well cleaning tool 155 that is shown attached to a customized tool mandrel 156. In FIG. 50 there is provided tool mandrel 156 holding split housing 157. Shown on split housing 157 are cleaning members 158 and external rings 159.

The following is a list of Reference Numerals used in the present invention:

LIST OF REFERENCE NUMERALS

Reference Number Description

1 derrick
2 block
3 elevator
4 tugger line
5 rotary table with slips
6 finger boards
7 mouse hole
8 Vee door
9 catwalk
10 wellbore
11 drill string
12 drill pipe joint/section
13 arrow
14 arrow
15 tool assembly
16 arrow
17 platform
18 arrow
19 arrow
20 tool apparatus
21 pin end portion/connector end portion
22 box end portion/connector end portion
23 cylindrical portion/connector end portion
24 cylindrical outer surface
25 support sleeve
26 sleeve half
27 sleeve half
28 locking clamp
29 centralizer ring
30 bolt/bolted connection
31 threaded connection
32 split bearing
33 compression spring
34 recess/socket
35 grub screw
36 conical spring
37 external threads
38 internal threads
39 magnet internal support sleeve
40 magnet
41 magnet spacer
42 minimal thickness section
43 socket/recess/bolt hole
44 bypass slot
45 slip segment
46 split cone ring
47 split slip ring
48 bolt/bolted connection
49 snap ring
50 tensioner sleeve
51 toothed portion
52 gap
53 segment
54 segment
55 opening
56 interlocking connection
57 threaded connection
58 external threads
59 internal threads
60 internally threaded opening
61 annular shoulder
62 annular shoulder
63 annular groove
64 annular groove
65 scraper tool
66 support sleeve
67 sleeve half
68 sleeve half
69 external split bearing
70 scraper/broach
71 external thread
72 C-ring
73 split bearing
74 pin
75 compression spring
76 interlocking connection
77 snap ring
78 spring support ring
79 annular end portion
80 brush tool
81 support sleeve
82 split bearing
83 compression spring
84 brush segment
85 mating groove
86 external thread
87 helical split
88 interlocking connection
89 broach
90 helical longitudinal cut
91 straight longitudinal cut
92 tortuous longitudinal cut
93 hole
94 scraper teeth
95 helical bypass groove
96 well cleaning tool
97 split housing/support sleeve
98 integral centralizer
99 cleaning member
100 external ring
101 well cleaning tool
102 split housing
103 centralizer ring
104 cleaning member
105 locking ring, threaded type
106 locking ring, lock wire type
110 well cleaning tool
111 split housing
112 cleaning member
113 external ring
114 recess/socket
115 recess/socket
116 well cleaning tool
117 split housing
118 cleaning member
119 external centralizer ring
120 spline
121 well cleaning tool
122 external ring
123 split housing
124 cleaning member
125 snap ring
126 locking ring/lock wire
130 well cleaning tool
131 dovetailed and crimped style brush insert
132 bullet style brush insert
133 stuffed style brush insert

134 split housing
135 external centralizer ring
140 well cleaning tool
141 split housing
142 cleaning member
143 external ring
145 well cleaning tool
146 split housing
147 half
148 half
149 hinge
150 cleaning member
151 external ring
155 well cleaning tool
156 tool mandrel
157 split housing
158 cleaning member
159 external ring The foregoing embodiments are presented by way of example only; the scope of the present invention is to be limited only by the following claims.

The invention claimed is:

1. A drill pipe mountable wellbore cleaning tool apparatus, comprising:

a) drill pipe joint having first and second end portions and a shaped portion in between the first and second end portions;

b) a support sleeve mounted to the drill pipe joint in between the first and second end portions;

c) wherein the support sleeve surrounds the shaped portion;

d) centralizers attached to the opposing ends of the support sleeve;

e) the support sleeve carrying one or more debris cleaning tools in between the centralizers that enable debris removal from a wellbore;

f) at least one locking clamp attached to the drill pipe, wherein the at least one locking claim restricts longitudinal movement of the support sleeve relative to the drill pipe joint.

2. The drill pipe mountable wellbore cleaning tool apparatus of claim 1, wherein there are a pair of the locking clamps attached to said shaped portion on opposing sides of the support sleeve.

3. The drill pipe mountable wellbore cleaning tool apparatus of claim 1, wherein the debris cleaning tool includes a scraper.

4. The drill pipe mountable wellbore cleaning tool apparatus of claim 1, wherein the drill pipe includes a cylindrical section and the locking clamp includes a plurality of circumferentially spaced slip segments that engage the drill pipe joint cylindrical section.

5. The drill pipe mountable wellbore cleaning tool apparatus of claim 4, wherein the locking clamp has a split cone ring that surrounds the slip segments.

6. The drill pipe mountable wellbore cleaning tool apparatus of claim 5, wherein the slip segments and split cone ring have correspondingly shaped inclined surfaces that engage.

7. The drill pipe mountable wellbore cleaning tool apparatus of claim 5, wherein the locking clamp has a tensioner sleeve that connects to the slip cone ring, wherein rotation of the tensioner sleeve relative to the slip cone ring forces the inclined surfaces together.

8. The drill pipe mountable wellbore cleaning tool apparatus of claim 1, wherein the locking clamp does not interlock with the support sleeve.

9. A method of cleaning a well comprising the steps of:

a) providing drill pipe joint having first and second end portions and a shaped portion in between the first and second end portions;

b) mounting a support sleeve to the drill pipe joint in between the first and second end portions;

c) attaching centralizers to the opposing ends of the support sleeve;

d) carrying one or more debris cleaning tools on the support sleeve in between the centralizers, each debris cleaning tool enabling debris removal from a wellbore;

e) locking one or more clamps to the drill pipe joint, wherein the one or more locking clamps longitudinally restricts longitudinal movement of the support sleeve relative to the drill pipe joint;

f) adding the drill pipe joint to a drill string; and g) cleaning the wellbore with the drill pipe joint of steps "a" through "e".

10. The method of claim 9, wherein in step "e" there are a pair of the locking clamps attached to the shaped portion on opposing sides of the support sleeve.

11. He method of claim 9, wherein in step "d" the one or more debris cleaning tools includes a scraper.

12. The method of claim 9, wherein in step "d" the one or more debris cleaning tools includes a magnet.

13. He method of claim 9, wherein in step "d" the debris cleaning tool is a brush.

14. The method of claim 9, wherein in step "b" the support sleeve comprises a pair of support sleeve halves that are fastened to each other.

15. The method of claim 14, wherein the support sleeve halves are bolted together.

16. The method of claim 9, wherein the locking clamp includes a plurality of circumferentially spaced slip segments engaging the drill pipe joint shaped section with the slips.

17. He method of claim 9, wherein the locking clamp does not interlock with the support sleeve.

18. A method of cleaning a well comprising the steps of:

a) providing drill pipe joint having first and second end portions and a shaped portion in between the first and second end portions;

b) mounting a support sleeve to the drill pipe joint in between the first and second end portions, wherein the support sleeve has a sleeve interior and the shaped portion is at least partially located in the sleeve interior;

c) attaching centralizers to the opposing ends of the support sleeve;

d) carrying one or more debris cleaning tools on the support sleeve in between the centralizers, each debris cleaning tool enabling debris removal from a wellbore;

e) locking a clamp to the drill pipe joint, wherein the clamp longitudinally restricts movement of the support sleeve relative to the drill pipe joint;

f) transferring the joint from a horizontal position to a vertical position and to a location next to a drill string;

g) adding the drill pipe joint to the drill string; and h) cleaning the wellbore with the drill pipe joint of steps "a" through "e".

19. He method of claim 18, wherein in step "b" the support sleeve comprises a pair of support sleeve halves that are fastened together.

20. He method of claim 18, wherein the locking clamp includes a plurality of circumferentially spaced slip segments engaging the drill pipe joint shaped section with the slips.

* * * * *